US010383363B2

(12) United States Patent
Bavar

(10) Patent No.: US 10,383,363 B2
(45) Date of Patent: Aug. 20, 2019

(54) HOOKAH BOWL AND HEAT MANAGEMENT ACCESSORY

(71) Applicant: KALOUD, INC., Los Angeles, CA (US)

(72) Inventor: Reza Bavar, Los Angeles, CA (US)

(73) Assignee: KALOUD, INC., Los Angeles, CA (US)

( * ) Notice: Subject to any disclaimer, the term of this patent is extended or adjusted under 35 U.S.C. 154(b) by 231 days.

(21) Appl. No.: 14/948,186

(22) Filed: Nov. 20, 2015

(65) Prior Publication Data

US 2016/0143353 A1 May 26, 2016

Related U.S. Application Data

(63) Continuation-in-part of application No. PCT/US2014/066709, filed on Nov. 20, 2014.

(51) Int. Cl.
*A24F 5/00* (2006.01)
*A24F 1/30* (2006.01)
(Continued)

(52) U.S. Cl.
CPC ..... *A24F 5/00* (2013.01); *A24F 1/30* (2013.01); *A24F 1/32* (2013.01); *A24F 5/04* (2013.01); *A24F 5/10* (2013.01); *A24F 5/14* (2013.01)

(58) Field of Classification Search
CPC ..... A24F 1/30; A24F 5/10; A24F 5/04; A24F 5/12; A24F 5/14; A24F 2700/08; A24F 5/00
(Continued)

(56) References Cited

U.S. PATENT DOCUMENTS 6,363,925 B1 * 4/2002 Chavana, Jr. ..... A47J 37/0731 126/25 A
2005/0279371 A1 12/2005 Billard et al.
(Continued)

FOREIGN PATENT DOCUMENTS

CN 201375016 Y * 1/2010
EP 2179667 A1 4/2010
WO WO 2016023325 A1 * 2/2016 ..... A24F 1/30

OTHER PUBLICATIONS

Shisa-ratgeber.com, Translation of "New mantel & windbreaker Heatereactor from Aladin" by Google.com, Published Apr. 16, 2014, Accessed Jan. 9, 2018.*
(Continued)

*Primary Examiner* — Michael J Felton
*Assistant Examiner* — Sonny V Nguyen
(74) *Attorney, Agent, or Firm* — Myers Wolin, LLC

(57) ABSTRACT

A system for facilitating smoking of tobacco from a hookah having a bowl with an interior space for holding organic matter to be smoked by a user, a heating platform for resting on the bowl with a central surface including a depression with at least one surrounding wall such that a heating source will not slide off the central surface, at least one perimeter vents arranged in a pattern around the central surface such that air can pass back and forth between an area above the central surface and below the central surface and at least one exterior vent located in at least one perimeter wall located around an exterior of the heating platform and a cap with at least one exterior vent, at least one upper vent, at least one movement control extension and at least one rest for resting on the heating platform.

16 Claims, 38 Drawing Sheets

(51) Int. Cl.

| | |
|---|---|
| ***A24F 1/32*** | (2006.01) |
| ***A24F 5/14*** | (2006.01) |
| ***A24F 5/04*** | (2006.01) |
| ***A24F 5/10*** | (2006.01) |

(58) Field of Classification Search
USPC ..... D27/162, 157, 168; 131/173
See application file for complete search history.

(56) References Cited

U.S. PATENT DOCUMENTS

| | | | | |
|---|---|---|---|---|
| 2006/0086364 | A1* | 4/2006 | Liu | A24F 1/30 131/173 |
| 2010/0126516 | A1 | 5/2010 | Yomtov et al. | |
| 2010/0126518 | A1 | 5/2010 | Saleh | |
| 2010/0212679 | A1* | 8/2010 | Bishara | A24F 1/30 131/173 |
| 2010/0242973 | A1 | 9/2010 | Mehio | |
| 2010/0275937 | A1* | 11/2010 | Shakouri Moghadam | A24F 1/30 131/196 |
| 2013/0330680 | A1 | 12/2013 | Bavar | |
| 2014/0326257 | A1 | 11/2014 | Jalloul et al. | |

OTHER PUBLICATIONS

HookahRev, "Kaloud Lotus Prototype", Youtube.com, Published Jul. 31, 2012, Accessed Jan. 12, 2018.*

World Tobacco, "Funno Design Windguard 2.0," Published in 2015, <http://worldtobaccosmokeshop.com/index.php?route=product/product&product_id=424>. (Year: 2015).*

Liu, Junliang, "Translation of CN 201375016 Y," Translated Sep. 24, 2018, Espacenet. (Year: 2018).*

WO, PCT/US2015/062019 ISR and Written Opinion, dated Mar. 3, 2016.

WO, PCT/US2015/062020 ISR and Written Opinion, dated Mar. 3, 2016.

* cited by examiner

HOOKAH BOWL AND HEAT MANAGEMENT ACCESSORY

CROSS REFERENCE TO RELATED APPLICATIONS

The present application is related to U.S. application Ser. No. 13/489,475, filed Jun. 6, 2012; and related to U.S. application Ser. No. 14/549,435, filed Nov. 20, 2014; and is a continuation-in-part of PCT/US2014/066709 filed Nov. 20, 2014 which are hereby incorporated by reference in their entirety. The present application is filed the same day and is co-pending with application Ser. No. 14/948,168 which is incorporated herein by reference in its entirety.

BACKGROUND OF THE INVENTION

The subject matter described herein relates generally to a system, device, and method preparing tobacco or other organic material for smoking using a water pipe, such as a hookah. Traditional water pipes generally include a plate for supporting charcoal, a head for containing tobacco, a body including an internal pipe, a base for containing water, and a hose. Typically a user will first fill the base with water and then place the internal pipe into the water such that the body creates an airtight seal with the base. The head is then filled with tobacco or other organic material and placed over the internal pipe such that an airtight seal is created between the internal pipe and the head. Next the user places the plate over the head, places one or more lit charcoals on the plate and these charcoals serve to heat the tobacco underneath the plate. The hose is typically attached to the body such that it has an airtight connection with air above the water in the base. The user can inhale through the hose which draws smoke from the heated tobacco in the head through the internal pipe, through the water contained in the base, through the hose and into the user's lungs.

The embodiments provided herein teach features and advantages heretofore untaught by the prior art, as will be clear to one of ordinary skill in the art.

SUMMARY OF THE INVENTION

Briefly and in general terms, the embodiments described herein provide for a system, method and device for smoking tobacco (or other organic matter) via a water pipe.

These and other aspects and advantages of the instant invention will be apparent from the following detailed description and the accompanying drawing, which illustrates by way of example the principles and features of the instant invention.

BRIEF DESCRIPTION OF THE SEVERAL VIEWS OF THE DRAWING(S)

Illustrated in the accompanying drawing(s) is at least one of the best mode embodiments of the present invention. In such drawing(s):

DETAILED DESCRIPTION OF THE PREFERRED EMBODIMENTS

Figure 1A:
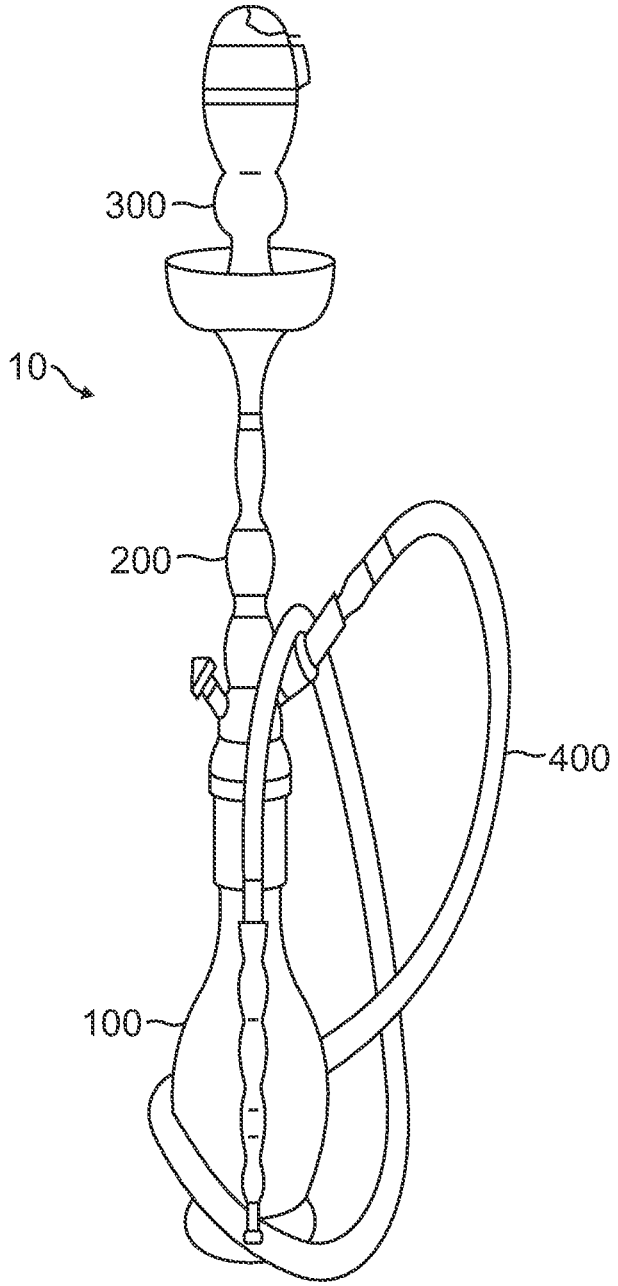
FIG. 1A illustrates an example embodiment of a water pipe in accordance with the present invention.

The above described drawing figures illustrate the described invention and method of use in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, it should be understood that what is illustrated is set forth only for the purposes of example and should not be taken as a limitation on the scope of the present invention.

FIG. 1 illustrates an exemplary water pipe 10 in accordance with at least one embodiment of the present invention. As shown in FIG. 1A, the water pipe generally comprises: a base 100, a stem 200, a bowl 300, and a hose 400. An exemplary water pipe is described in U.S. patent application Ser. No. 13/489,475, filed on Jun. 6, 2012, the entire contents and disclosure of which is herein incorporated by reference.

Figure 1B:
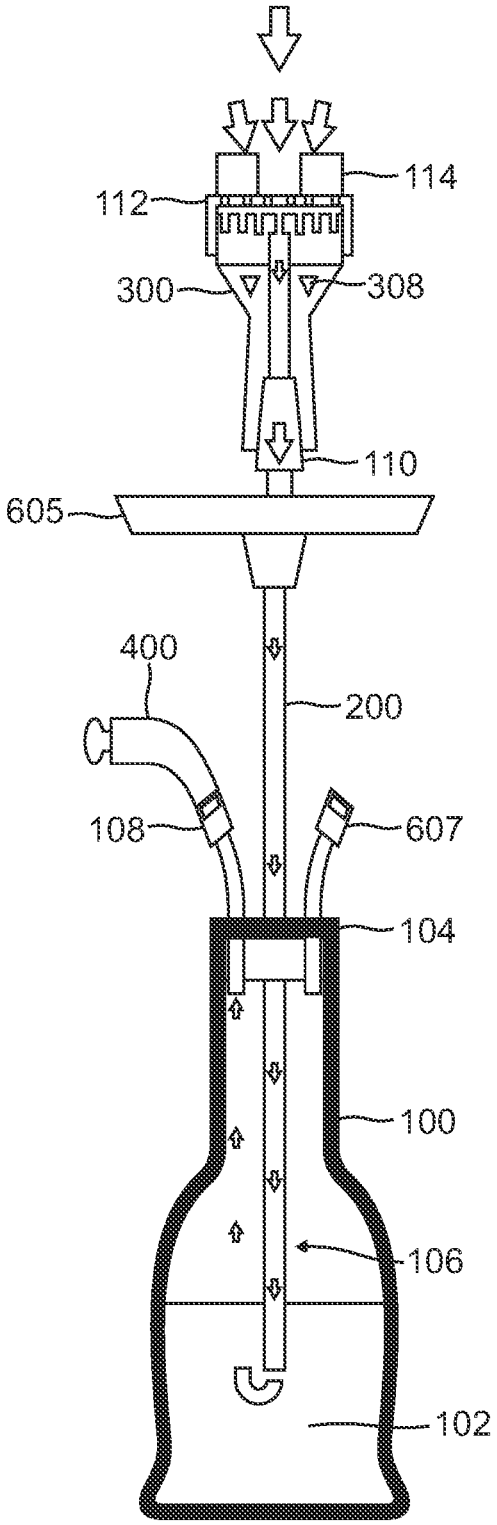
FIG. 1B shows a schematic view of an example embodiment of a water pipe in accordance with the present invention

As shown for example in FIG. 1B, in general, the base 100 comprises a concave vessel having an open top portion for containing water or other liquid 102 therein. The stem 200 extends into the base such that a distal end of the stem is partially submerged within the liquid 102 contained therein. The stem 200 also couples to the open top portion of the base so as to form a substantially airtight seal therewith. Accordingly, a first base grommet 104 may be provided to couple the stem 200 and the base 100 so as to form the substantially airtight seal. In this manner, a chamber is formed by the base 100 and stem 200/grommet 104. The hose 400 extends into the base 100 such that a proximal portion of the hose 400 is in fluid communication with the chamber 106, though preferably not within the contained liquid 102 (e.g. air can pass between chamber 106 and hose 400). Preferably, a substantially airtight seal is formed from the coupling of the hose 400 and base 100. Accordingly, a second hose grommet 108 may be provided to couple the hose 400 and the base 100 so as to form the substantially airtight seal. In some embodiments, a hose valve (not shown) may be intermediate the hose 400 and the base 100, the hose valve extending into the chamber 106 at one end and exterior to the chamber 106, coupling with the hose 400, at the other. Bowl 300 couples to a proximal end of stem 200 such that a substantially airtight seal is formed therebetween. Accordingly, a third bowl grommet 110 may be provided to couple bowl 300 and stem 200 so as to form the substantially airtight seal. In operation, organic matter to be smoked 308 may be contained within bowl 300, and bowl 300 may be covered with a cover 112, such as punctured foil, or a ventilated cover such as that described in U.S. patent application Ser. No. 13/489,475, filed on Jun. 6, 2012, the entire contents and disclosure of which is herein incorporated by reference. Coals 114 or other combustible heating material can be placed on or in cover 112 to heat the tobacco 308.

Critically, bowl 300, stem 200 and hose 400 each comprise a hollow tube such that when base 100, bowl 300, stem 200 and hose 400 are coupled, an airflow path is formed. As illustrated in FIG. 1B, a user inhaling at the distal end of hose 400 may thus draw heated air into bowl 300, causing the organic material 308 therein to burn, releasing smoke that is subsequently drawn through bowl 300, through stem 200, and into liquid 102 contained within chamber 106 of base 100. The smoke then rises through liquid 102 into the preferably sealed area above liquid 102 in the chamber 106, becoming filtered in the process, and inhaled through hose 400 as it is smoked by the user.

Other water pipe components, such as purge valves, ashtrays, base flavorings, etc. are generally known in the art and, while not specifically described herein, are intended to be useable in combination with the presently described embodiments without departing from the scope of the invention.

An example embodiment of a bowl 300 in accordance with the present invention will now be described with reference to FIG. 2.

Figure 2A:
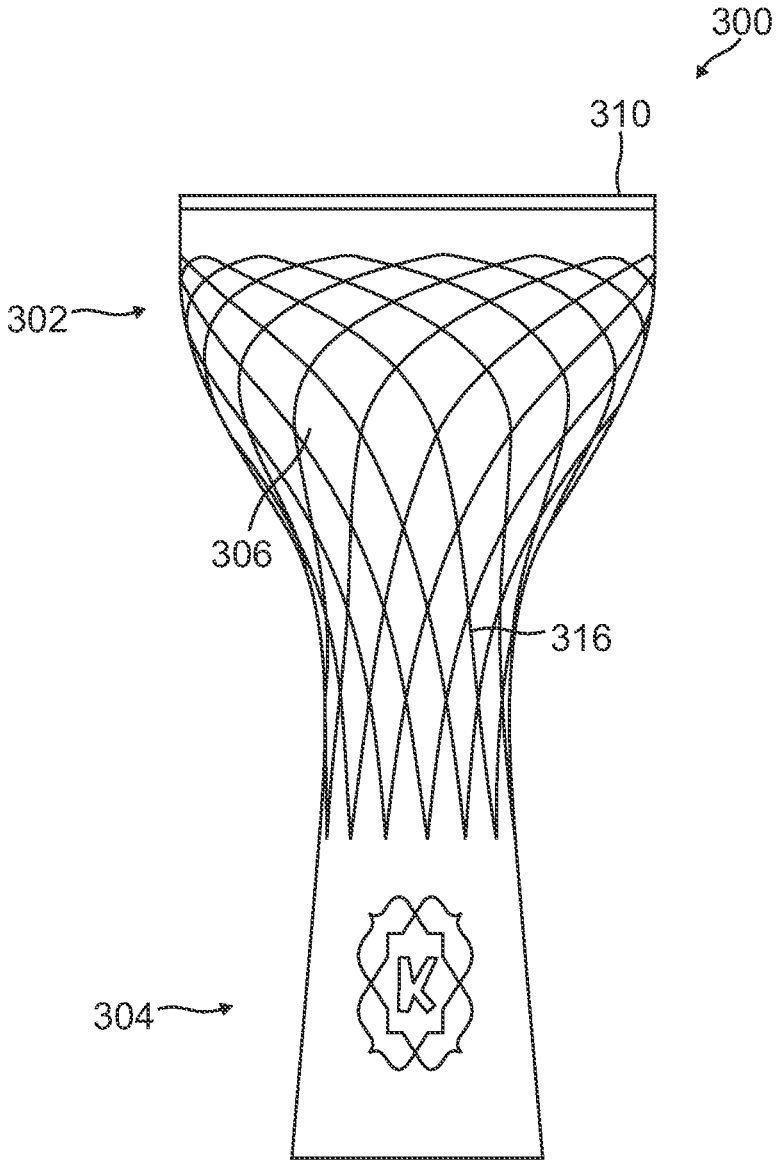
FIG. 2A shows a side view of the example embodiment of a bowl in accordance with the present invention.
Figure 2B:
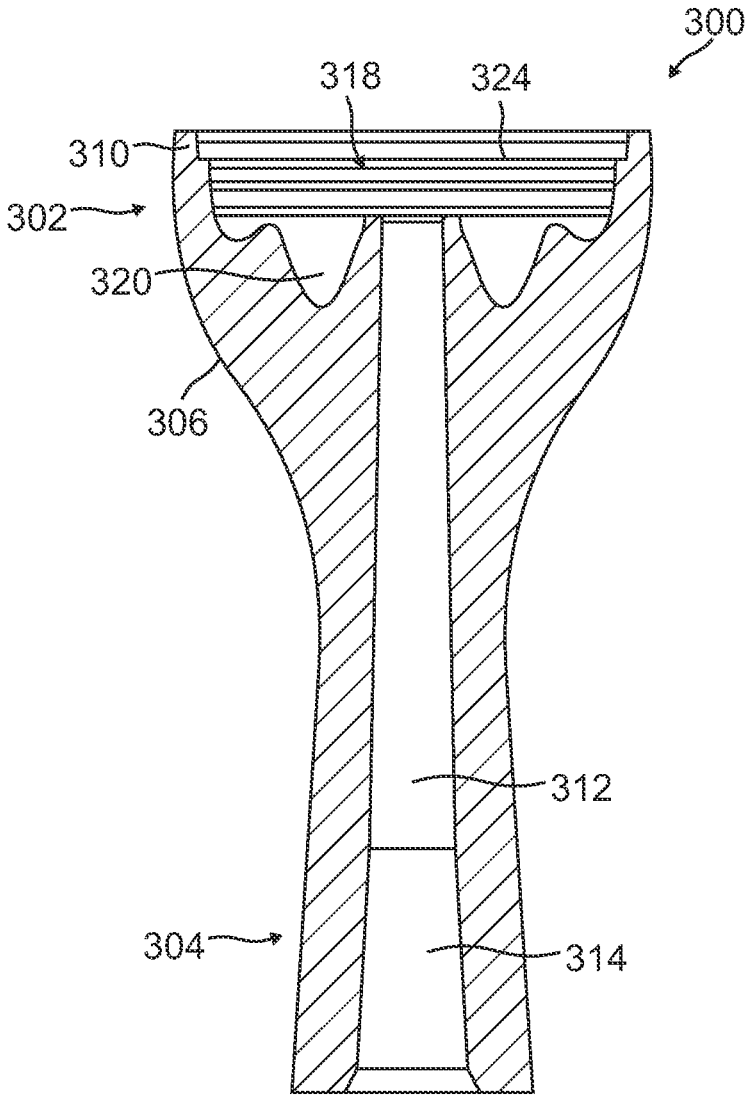
FIG. 2B shows a cutaway view of the example embodiment of a bowl in accordance with the present invention.
Figure 3A:
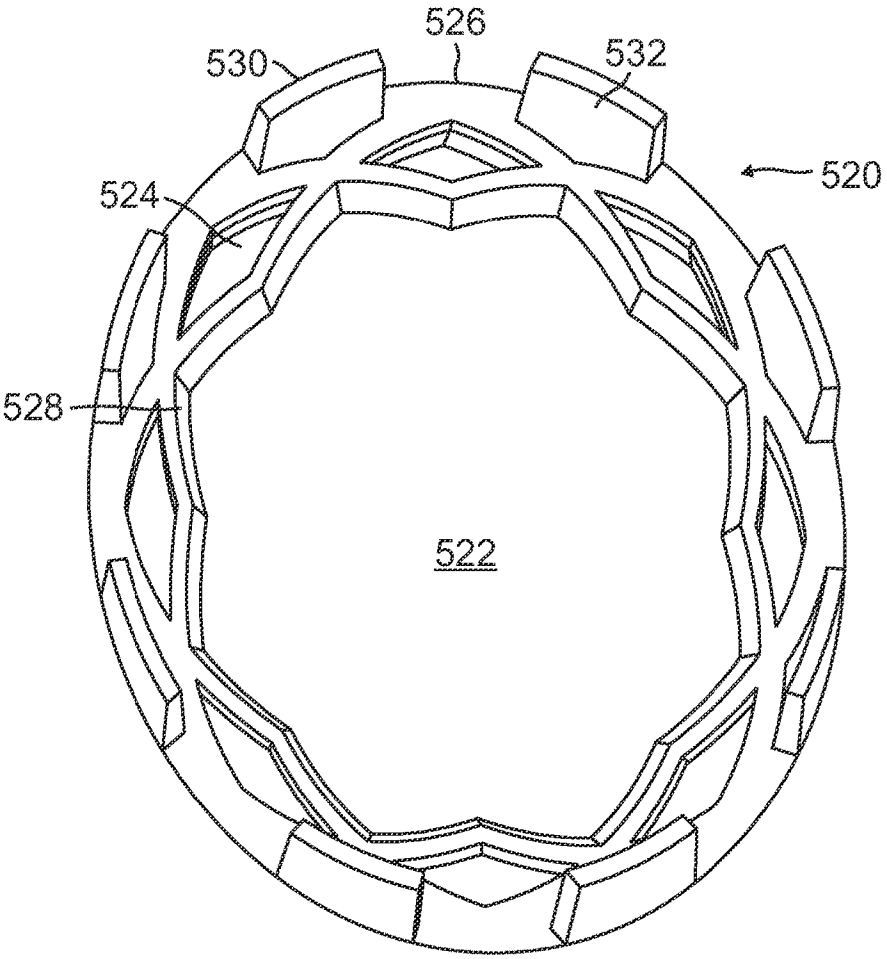
FIG. 3A shows a perspective view of an example embodiment of a ventilated cover platform in accordance with the present invention.
Figure 3B:
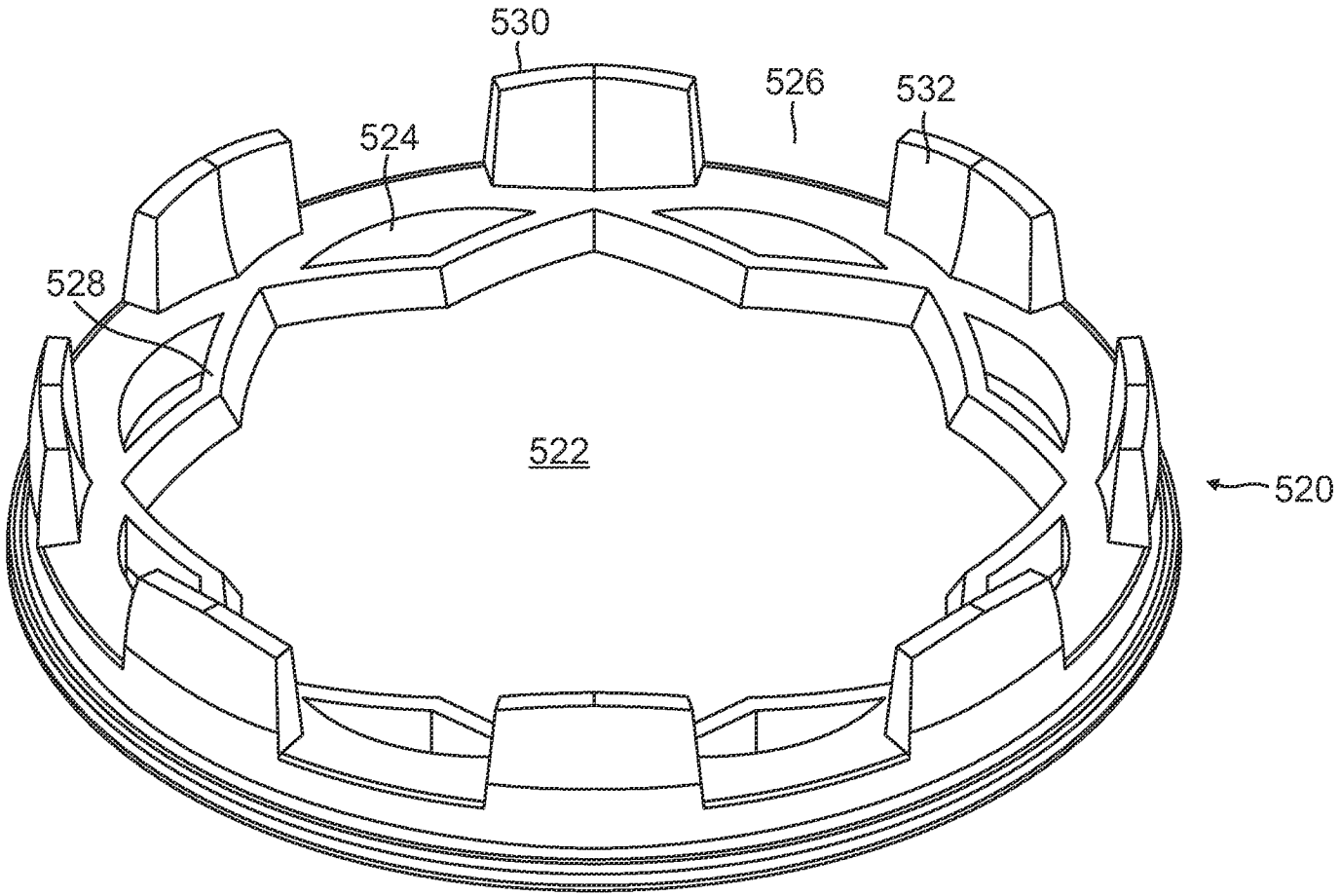
FIG. 3B shows a perspective view of an example embodiment of a ventilated cover platform in accordance with the present invention.
Figure 3C:
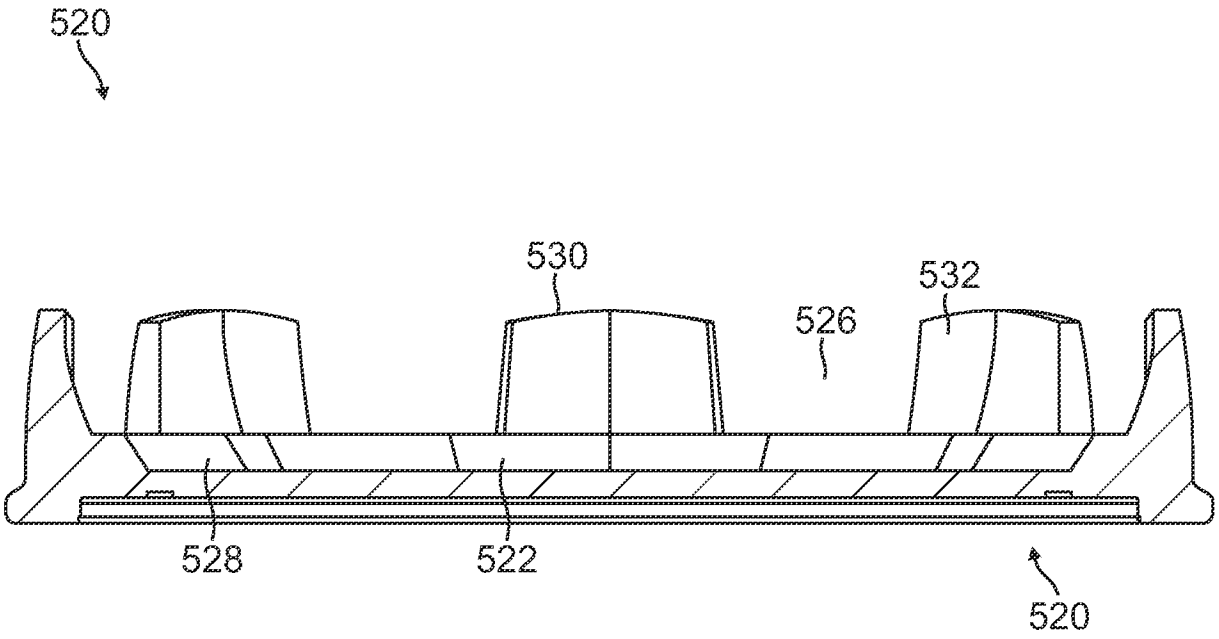
FIG. 3C shows a cutaway side view of an example embodiment of a ventilated cover platform in accordance with the present invention.
Figure 3D:
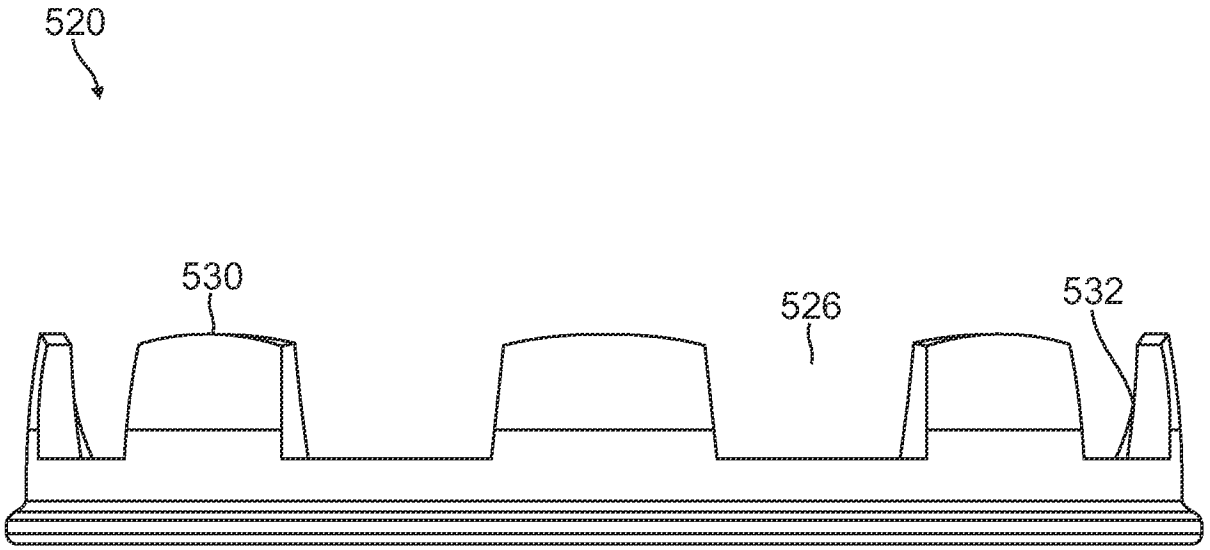
FIG. 3D shows a side view of an example embodiment of a ventilated cover platform in accordance with the present invention.
Figure 3E:
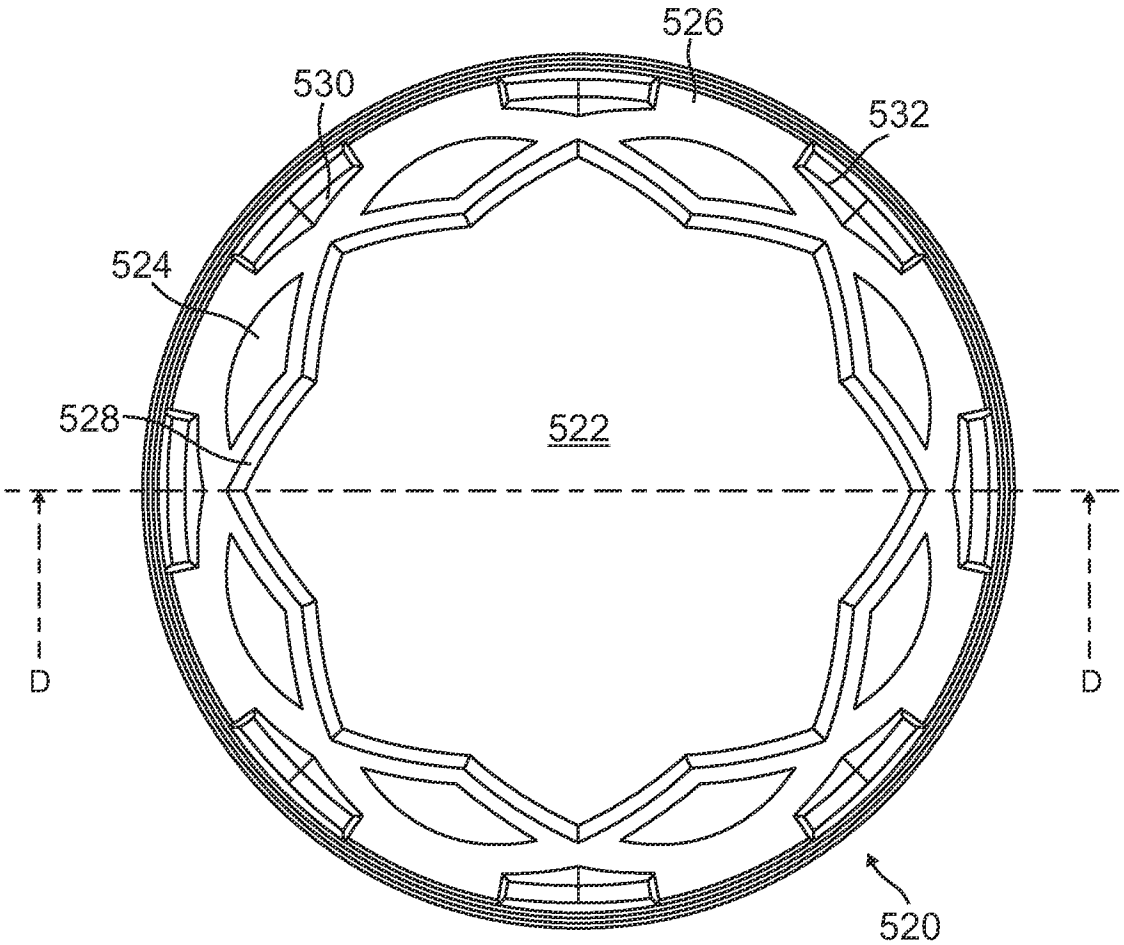
FIG. 3E shows a top view of an example embodiment of a ventilated cover platform in accordance with the present invention.
Figure 4A:
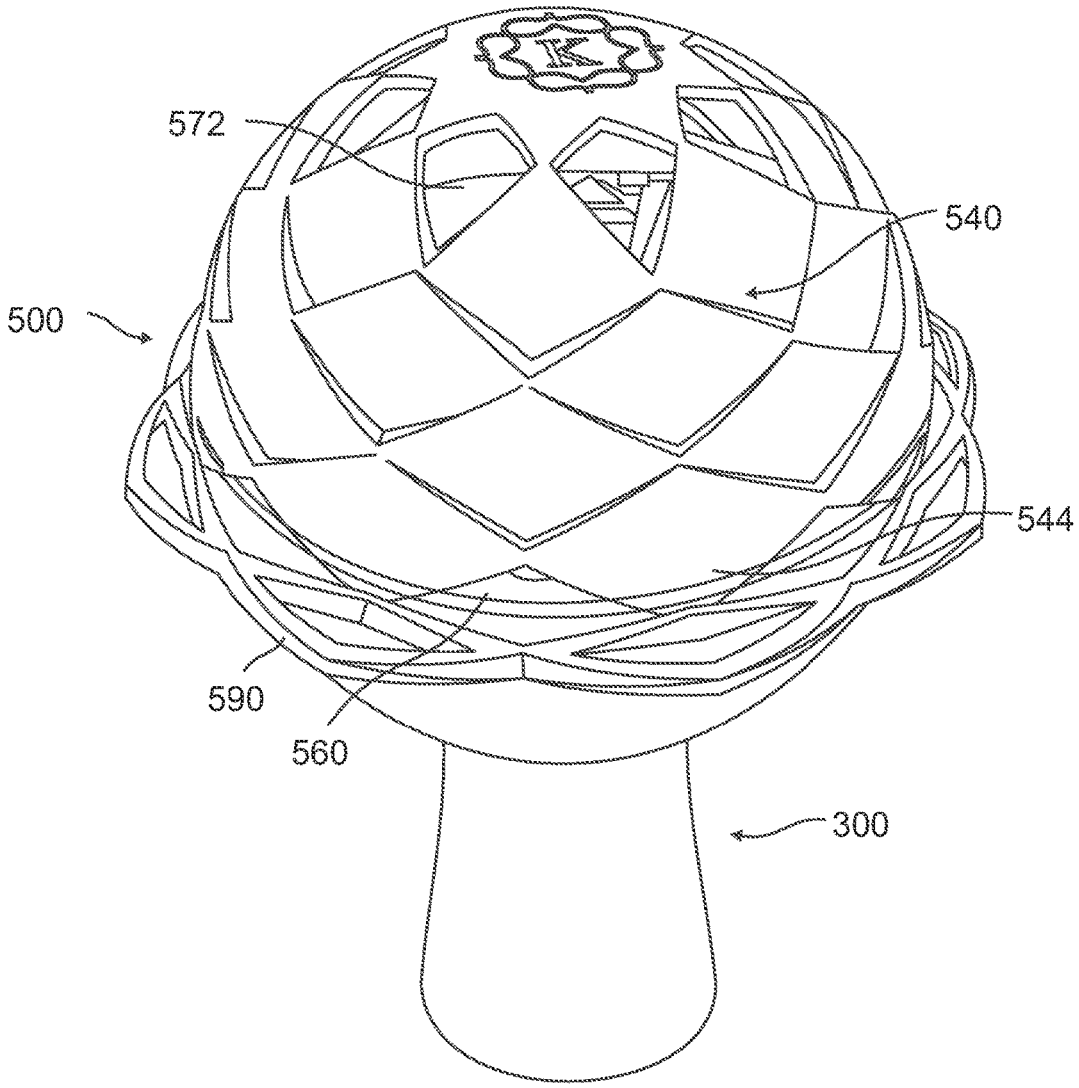
FIG. 4A shows a perspective view of the example embodiment of a ventilated cover cap on a bowl in accordance with the present invention.
Figure 4B:
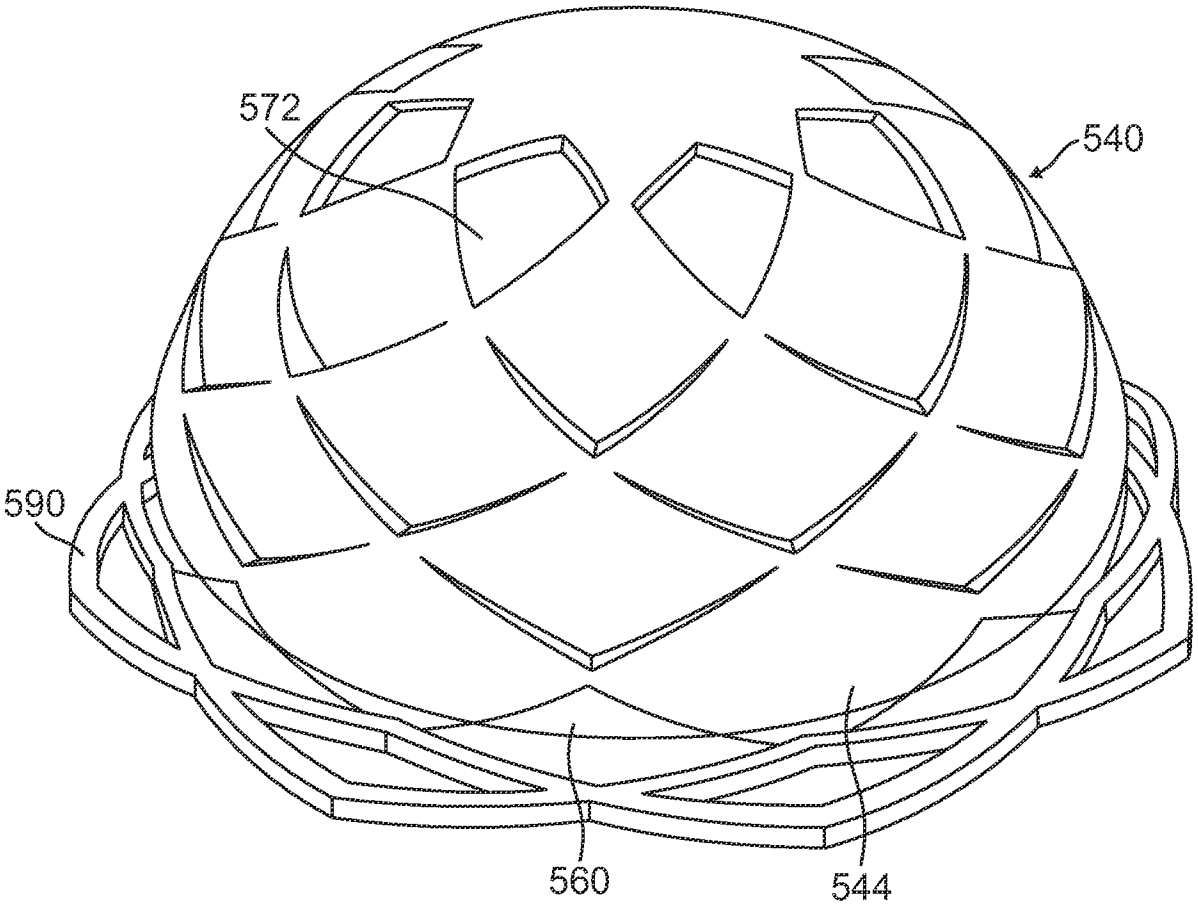
FIG. 4B shows a perspective view of the example embodiment of a ventilated cover cap in accordance with the present invention.
Figure 4C:
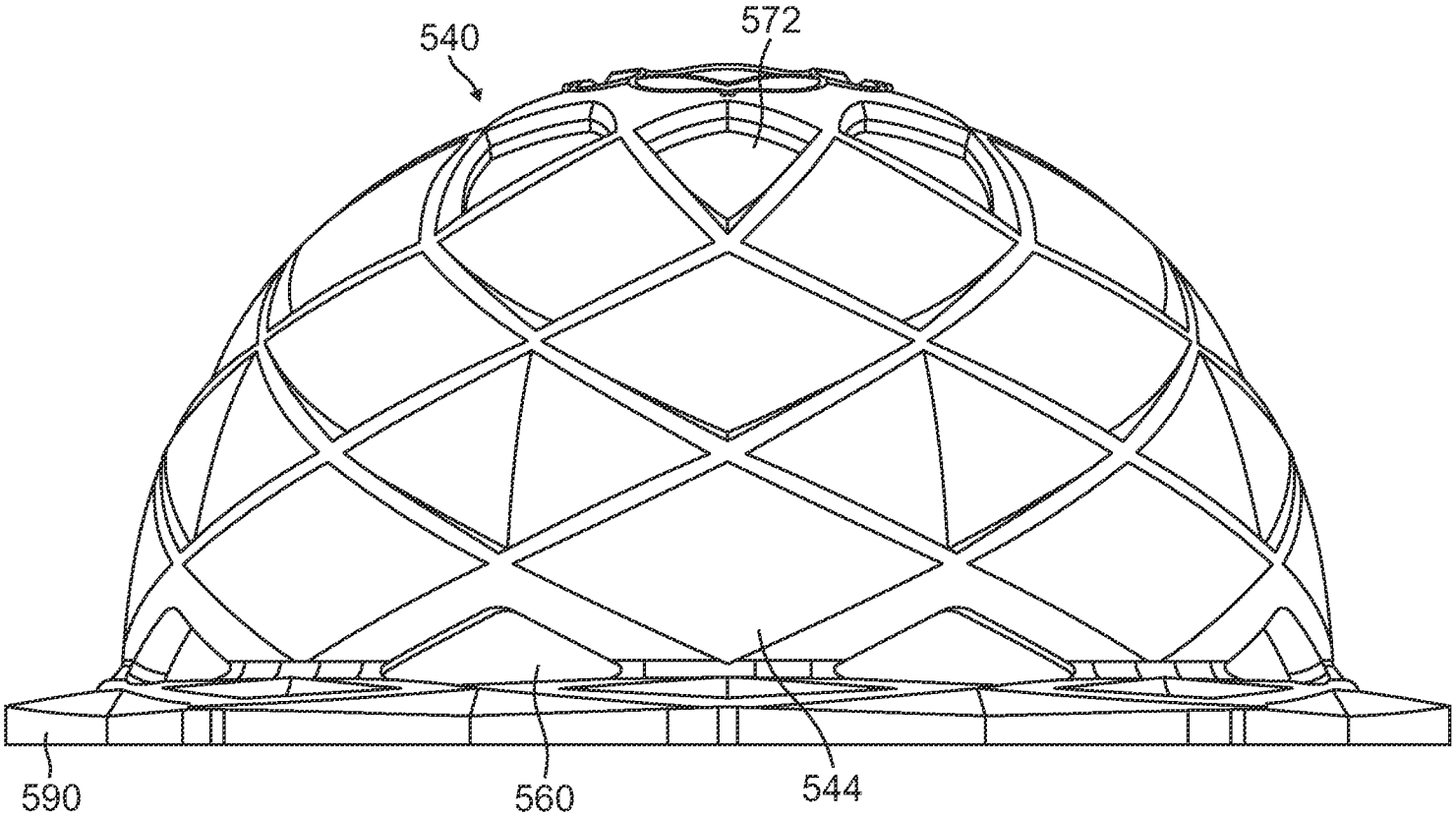
FIG. 4C shows a side view of the example embodiment of a ventilated cover cap in accordance with the present invention.
Figure 4D:
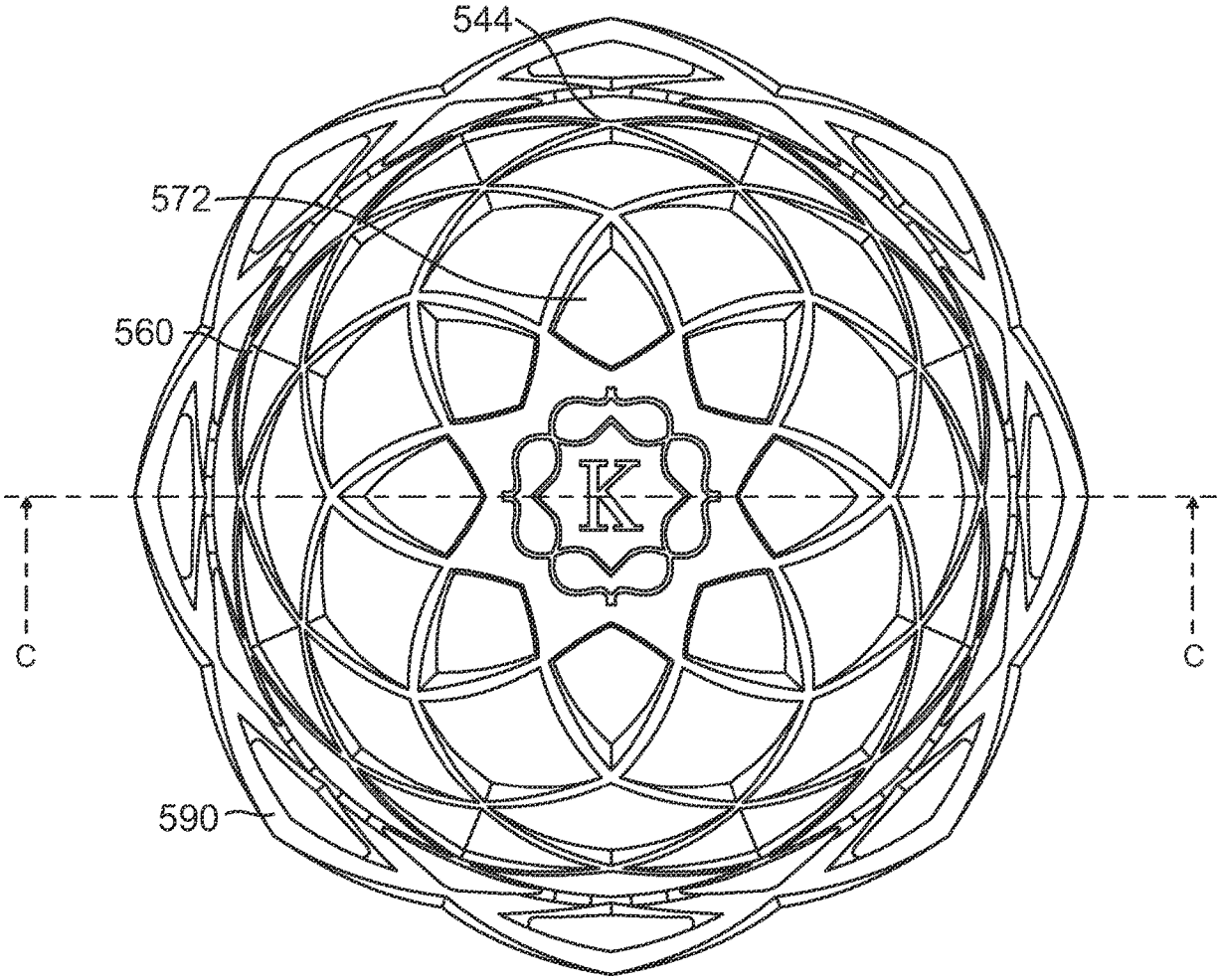
FIG. 4D shows a top view of the example embodiment of a ventilated cover cap in accordance with the present invention.
Figure 4E:
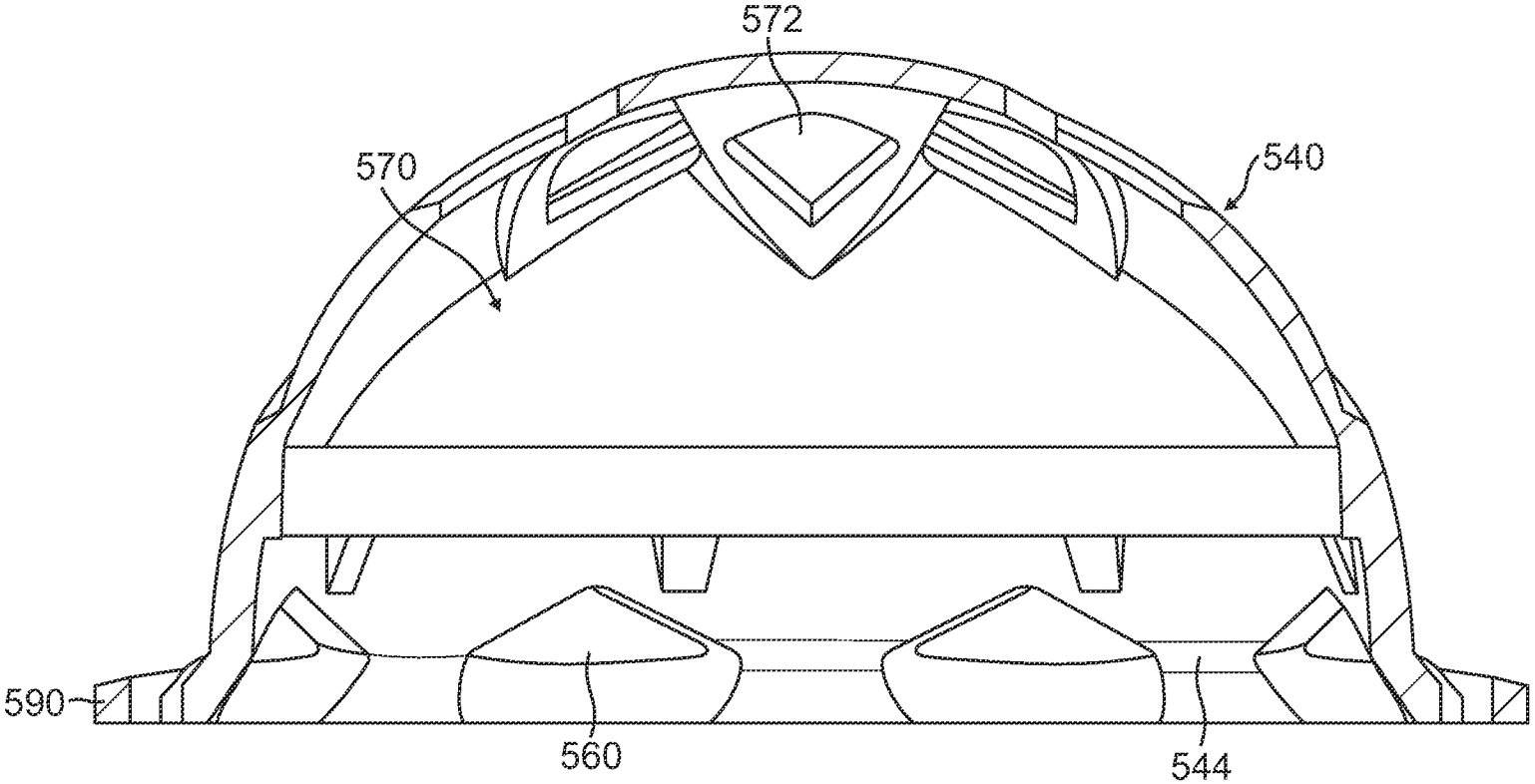
FIG. 4E shows a cutaway side view of the example embodiment of a ventilated cover cap in accordance with the present invention.

As shown for example in FIGS. 2A-2B, a bowl 300 preferably generally comprises a substantially hemispherical bowl head 302 extending vertically and radially from a substantially cylindrical bowl stalk 304. As shown, bowl stalk 304 may be flared outward at its bottom end to facilitate easier manipulation. The bowl 300 preferably further comprises interior 307 and exterior 306 surfaces separated by a rim portion 310. In some embodiments, located central to the bowl head 302, and forming a portion of the inner surface of the bowl 300, may be a hollow tube 312 extending the length of the bowl 300 from the bowl head 302 through the bowl stalk 304. The hollow tube 312, and other structures herein described, are additionally shown in FIG. 2B, which is a cross-sectional illustration of an example embodiment of a bowl 300.

Bowl head 302 preferably further comprises a plurality of compartments 320 therein for containing the organic matter or other material to be smoked. Accordingly, internal walls 322 may separate adjacent compartments 320. A plurality of internal walls 322 may extend inward from the interior surface of the bowl head to hollow tube 312, forming the plurality of compartments 320. Accordingly, each internal wall 322 may partially or wholly separate adjacent compartments 320. Compartments 320 may have varied dimensions and may be uniform or sized differently in different embodiments. In the example embodiment each compartment is of equal depth and similar dimensions and shape. Each compartment may have a "U" shaped cross sectional profile when viewed from a side. Alternatively, each compartment may have a "V" shape, open-top square shape, open-top rectangular shape or other shapes.

As shown in FIG. 2B, in some embodiments the compartments 320 are slightly recessed from an upper elevation of the rim 310, forming a space 318 between a cover and the organic matter to be smoked so as to promote airflow from the organic matter to the hollow tube 312.

As shown for example in FIG. 2B, the bowl stalk 304 may further comprise a grommet 314 for effecting a substantially airtight seal with a water pipe stem. In some embodiments the grommet 314 may include threading, tread, ribs or other surface characteristics. Grommet 314 may be the same material as the rest of bowl 300 although in some embodiments it may also be a different material. For instance, grommet 314 may be rubber to promote better sealing characteristics. Grommet 314 may be flared as shown in the example embodiment of FIG. 2C by the concentric rings at the center. This may create a conical cross section of grommet 314 when viewed from the side of bowl 300. The conical cross section may promote better sealing characteristics with a water pipe stem and ease of user coupling of head 300 with the water pipe stem. In operation, the grommet 314 can replace a traditional bowl grommet shown in FIG. 1B.

As shown for example in FIG. 2A, an exterior surface of the bowl may comprise a grip portion 316. In some embodiments, this grip portion 316 may include a friction surface providing additional grip to the user. The grip surface may include ridges, bumps, depressions and other features. The grip portion 316 in the example embodiment is a series of lines with arcing features, running generally parallel to each other around bowl 300. A similar series of lines with arcing features in an opposite direction run generally substantially parallel to each other around bowl 300 such that numerous intersections of each set of lines with any one line creates a cross-hatched pattern around bowl 300.

In at least one embodiment, bowl 300 is made of silicone material. Silicone may have advantages such as improved insulation around the head 302 and improved heat distribution inside the head 302 and may also provide improved uniformity of heat distribution. Improved insulation around head 302 may provide an improved user experience since users are less likely to burn themselves when handling bowl 300 when it is hot. Improved heat distribution inside head 302 may provide an improved user experience since it promotes even heating characteristics for organic matter in compartments 320. As such, organic matter may be evenly heated and less likely to have some portions burn while others remain unheated. In other embodiments clay, marble, glass, or other appropriate materials may be used.

As shown for example in FIG. 2B, the rim portion 310 may further comprise a coupling surface for frictionally coupling a cover (not shown) to the bowl such that charcoal or other heat source may provide heat to the tobacco or other organic substance while remaining separated therefrom, in accordance with the embodiments and concepts discussed herein. This coupling surface can include ridges 324 which can be arranged in a fashion to promote an airtight seal and a screwing type seal. In some embodiments, the cover preferably comprises a ventilated cover, such as the exemplary ventilated cover show for example in FIGS. 3A-6E, as well as the ventilated cover described in U.S. patent application Ser. No. 13/489,475, filed on Jun. 6, 2012. In some embodiments, a coupling surface may be an interior surface of the rim 310. In some embodiments, the coupling surface may be an exterior surface of the rim 310. In some embodiments, the coupling surface may be an upper surface of the rim 310. In some embodiments, the coupling surface may be a combination of more than one of an exterior, interior and upper surface of the rim 310. Preferably, the coupling surface includes tread, threading, ribs or similar structure adapted to increase the frictional coupling of the cover with the bowl 300.

In accordance with the bowl of FIG. 2, a user can insert a metered amount of tobacco, shisha or other organic material into one or more of compartments 320 before or after coupling bowl 300 with a stem of a water pipe in order to prepare the bowl 300 for smoking.

FIGS. 3-4 illustrate an example embodiment of a ventilated cover 500 for use in accordance with at least one embodiment of the present invention. The ventilated cover 500 may include a platform 520 on which to support coal or other heating source as shown in FIG. 3, and a cap 540 resting on or coupled to the platform so as to form a heating chamber 570, as shown in FIG. 4E-4F, 5A-5B. Airflow through cover 500 may be controllable by rotating cap 540 relative to the platform 520.

As shown in FIGS. 3A-3C, 5A-5B and 5F-5G, the platform 520 preferably comprises a recessed tray 522 for containing the heating source. The platform 520 also preferably comprises a plurality of perimeter bowl vents 524 for permitting airflow between the heating chamber and the bowl while in operation. As shown, eight perimeter bowl vents 524 may be used although other numbers of perimeter bowl vents 524 are also contemplated. The platform 520 also preferably comprises a plurality of perimeter vertical protrusions 530 that mate with corresponding protrusions 544 of the cap 540 to form circumferential vents 526 for controlling the airflow between the exterior atmosphere and the heating chamber. In various embodiments this mating may occur using screws and threading.

As the cap 540 is rotated relative to the platform 522, for instance by rotating cap 540 using rim 590 of FIG. 4, the respective protrusions 530 and spaces therebetween (i.e. the formed circumferential vents 526) may transition between fully open, partially open and fully closed with respect to adjustable side vents 560. In this manner, airflow to a heating chamber (e.g. 570 of FIG. 4E) may be controlled. In some embodiments, the cap 540 may further comprise additional upper vents 572, which may or may not be adjustable in different embodiments.

Platform 520 may be comprised of forged aluminum or steel. Similarly, cap 540 may be comprised of forged aluminum or steel.

Recessed tray 522 may include walls 528 which are flared inward from their upper edges. Walls 528 may prevent coals or other heating elements from sliding or otherwise moving around within heating chamber 570 during adjustment by users. The inward, downward flare of walls 528 may further promote airflow within heating chamber 570 by channeling air toward the heating elements. In the example embodiment, recessed tray 522 has a star configuration with eight points. Other embodiments may incorporate other shapes without departing from the scope of the invention. It has been discovered, however that the eight-pointed star configuration provides benefits over other shapes, including benefits of even heating and air flow, particularly when combined with the multi-chambered bowl described herein.

Circumferential vents 526 may comprise alternating spaces between vertical protrusions 530. The inner surface 532 of each vertical protrusion 530 may create a substantially "V" shape with the point directed inward, toward the center of heating chamber 570 from the circumferential vents 526 on either side of the vertical protrusion. Accordingly, air may be channeled toward heating elements on recessed tray 522. Additionally, the point of each "V" may correspond with each star point of recessed tray 522. It has been discovered that embodiments utilizing such an arrangement benefit from the created air channels which may promote circulation within heating chamber 570 and promote even heating of the coals or other heating elements during use.

Vertical protrusions 530 may be 1 mm to 100 mm in height. Circumferential vents 526 may be 1 mm to 100 mm in width and 1 mm to 100 mm in length.

Perimeter bowl vents 524 may be diamond, or other, shaped holes allowing airflow from the interior of heating chamber 570 into bowl 300. Each perimeter bowl vent 524 is preferably located near, such as directly in front of, a circumferential vent 526. This may promote a mixture of cool air from the exterior of the cap 540 with heated air from the interior of heating chamber 570 such that during inhalation by a user, heated air is not exclusively the only air being pulled through the water pipe. The location of perimeter bowl vents 524 as radially aligned with and proximate each circumferential vent 526 further promotes air flow, as discussed herein with respect to FIG. 5A. Perimeter bowl vents 524 may have dimensions of 1 mm to 100 mm in width and 1 mm to 100 mm in length.

Rim 590 may be an outward extension of cap 540 from a central axis perpendicular to heating platform 520 that allows users to rotate cap 540 with respect to platform 520. This may allow for different configurations of adjustable side vents 560 with respect to circumferential vents 526, allowing a user to control air flows into and out of heating chamber 570. Rim 590 is shown as a series of pointed extensions, attaching to cap 540 at protrusions 544 in FIG. 4. In some embodiments, rim may be insulated such that it may be handled by hand. Although rim 590 is shown as circumferentially surrounding cap 540 in FIGS. 4 and 5, it should be understood that it may only protrude outward in a single location, in a plurality of locations, or in partial circumferential areas.

In accordance with the embodiments described above and shown in FIGS. 4 and 5, a user can place or otherwise couple a platform 522 on or with a rim of a bowl 300 and thus, above tobacco, shisha or other organic matter already prepared as described above. Then a user can place coals or other combustible material on platform 522. Once the coals or other combustible material are in place, they can be heated by a heat source, for example a match or lighter, before a user places or otherwise couples a ventilated cap 540 on platform 522.

Figure 5A:
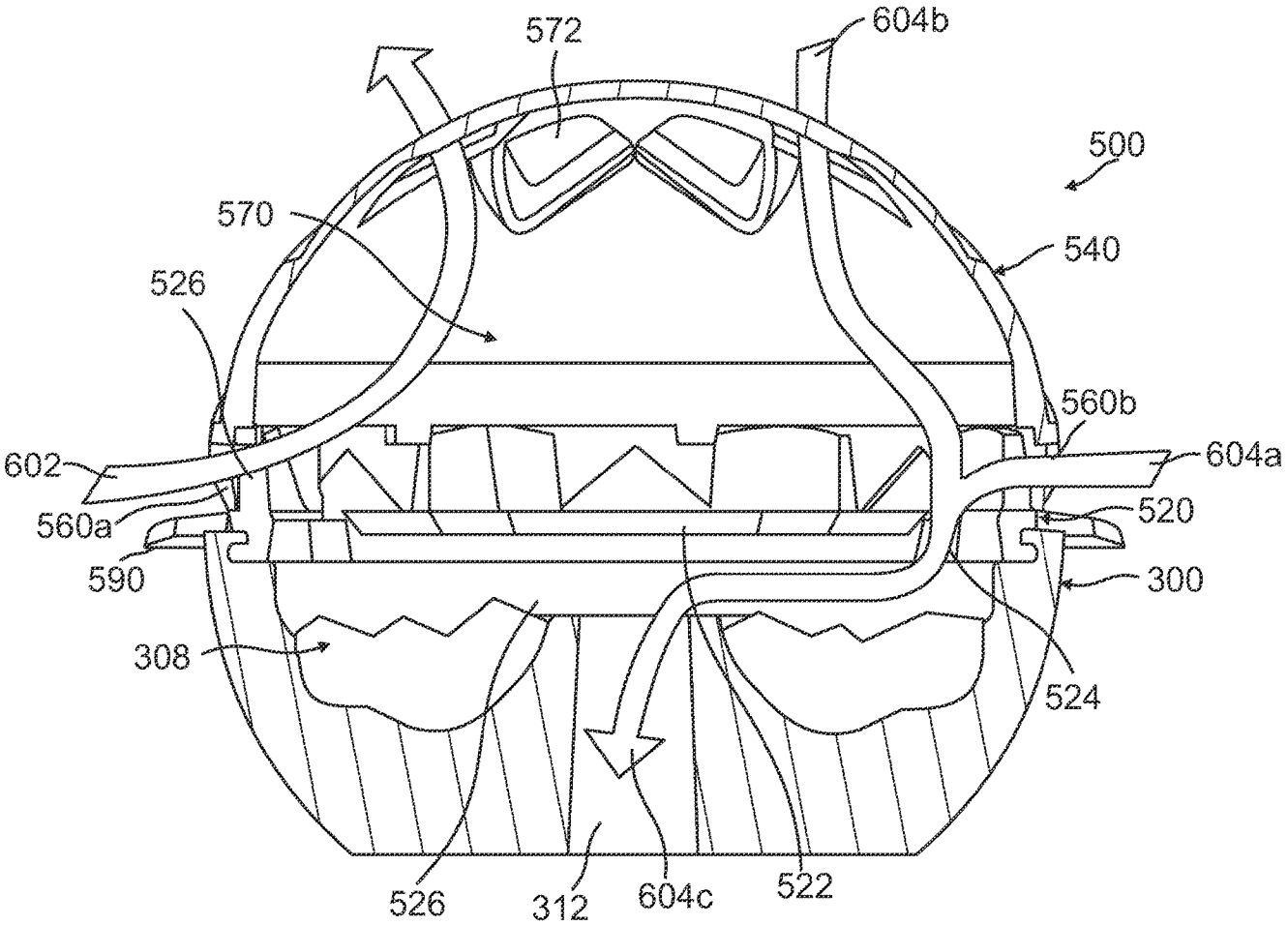
FIG. 5A shows a cross sectional view of the example embodiment of a coupled ventilated cover cap, platform and head including airflow in accordance with the present invention.

Turning to FIG. 5A, a cross sectional view of the exemplary ventilated cover 500 and head 300 including airflows 602, 604 is shown in accordance with at least one embodiment of the present invention. In the example embodiment airflow 602 represents at least one way in which air may move through heating chamber 570 when the device has coals (not shown) on platform 522 but air is not actively being pulled or otherwise inhaled through the water pipe. To elaborate, warm air within heating chamber 570 may rise through upper vents 572. Cooler air may enter heating chamber 570 through adjustable side vents 560 (here since multiple air flows 602 and 604 are shown, represented by adjustable side vent 560*a*) and then circumferential vents 526 to be heated by coals on platform 522. Thus air flow 602 during idle air times (e.g. non-active air pull or inhalation) is created.

Airflow 604 including 604*a* and 604*b* shows the flow of air when an active air pulling or inhalation through the water pipe occurs and the combination airflow 604*c* shows airflow through head 300 and into the lower components of the water pipe. Here, when a user is actively pulling air or inhaling through the water pipe, air may enter cap 540 into heating chamber 570 through upper vents 572 as flow 604*b*. Likewise, air may enter cap 540 into heating chamber 570 through adjustable side vent 560*b* and circumferential vent 526. Thus, the air passes heated coals on platform 522 and is pulled through perimeter bowl vents 524. At such point, it enters a space 318 between cover 522 and tobacco or other organic matter 308 to be smoked. In this space, the air may pick up smoke particles emanating from the heating of organic matter 308 by coals on platform 522 and combine into a single flow 604*c* through hollow tube 312.

Figure 5B:
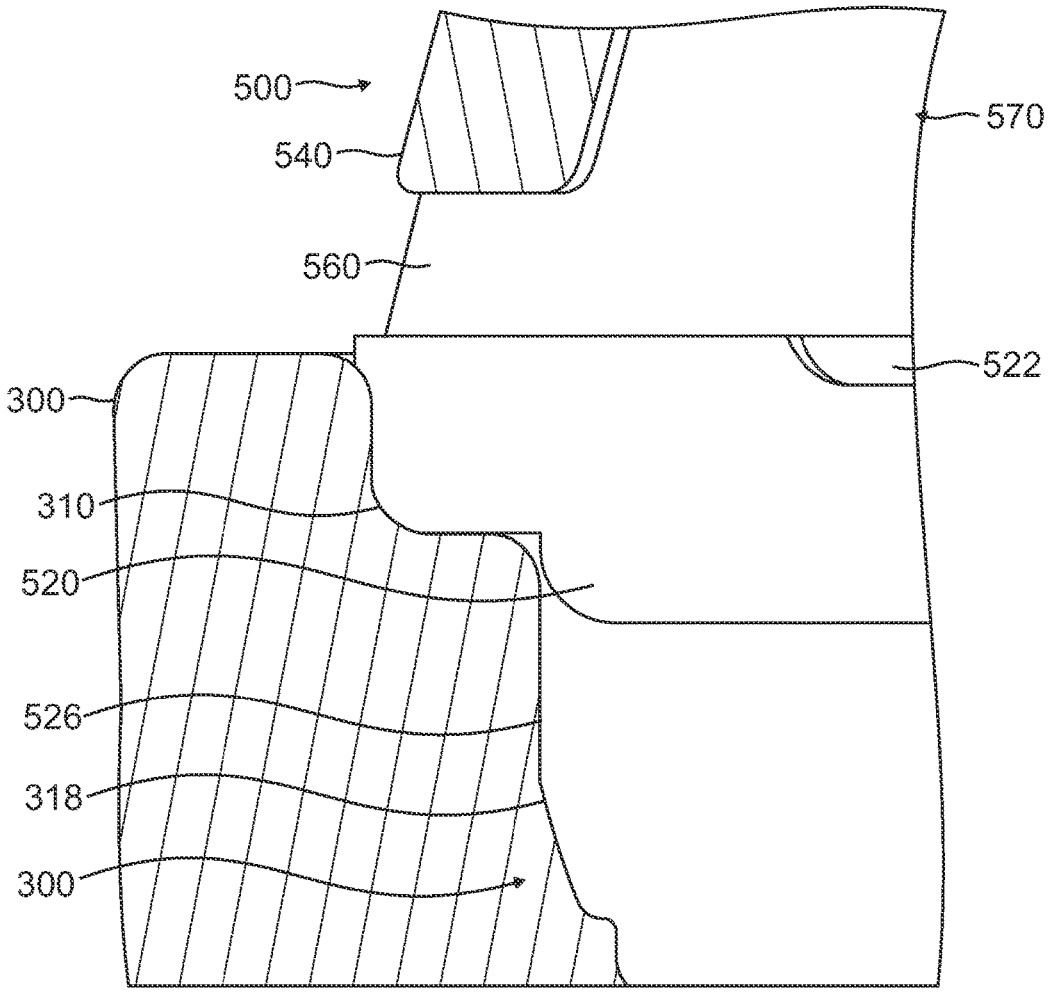
FIG. 5B shows a close-up cross sectional view of the example embodiment of a coupled ventilated cover cap, platform and head in accordance with the present invention.

FIG. 5B shows a cross sectional view of an example embodiment of ventilated cover 500 and head 300 in accordance with at least one embodiment of the present invention. In the example embodiment platform 522 is shown resting and nested in a complementary shaped rim portion 310 while cap 540 may rest on platform 522. As discussed elsewhere herein, one or both of these resting positions can include coupling mechanisms.

Figure 5C:
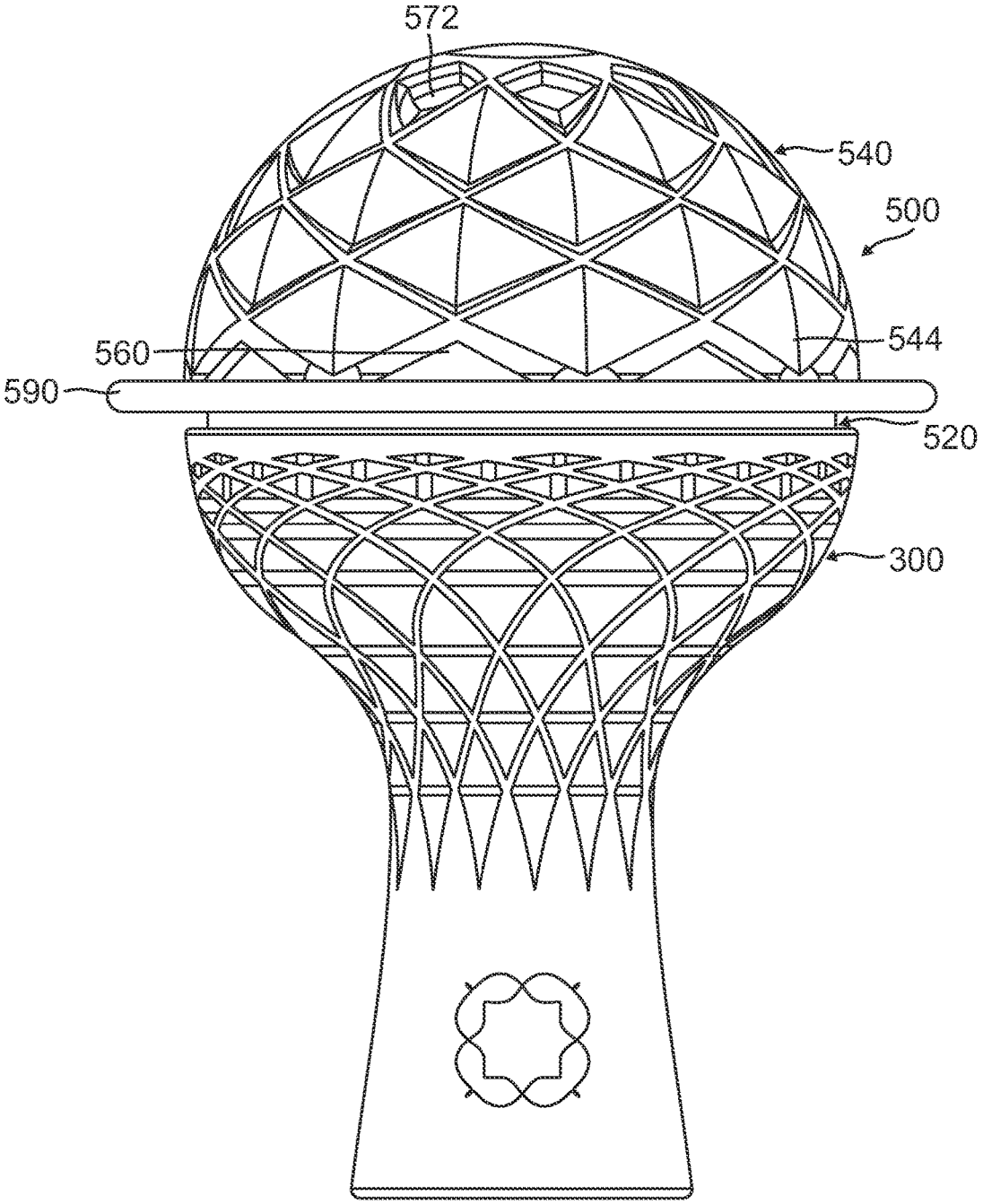
FIG. 5C shows a side view of the example embodiment of a coupled ventilated cover cap, platform and head in accordance with the invention.
Figure 5D:
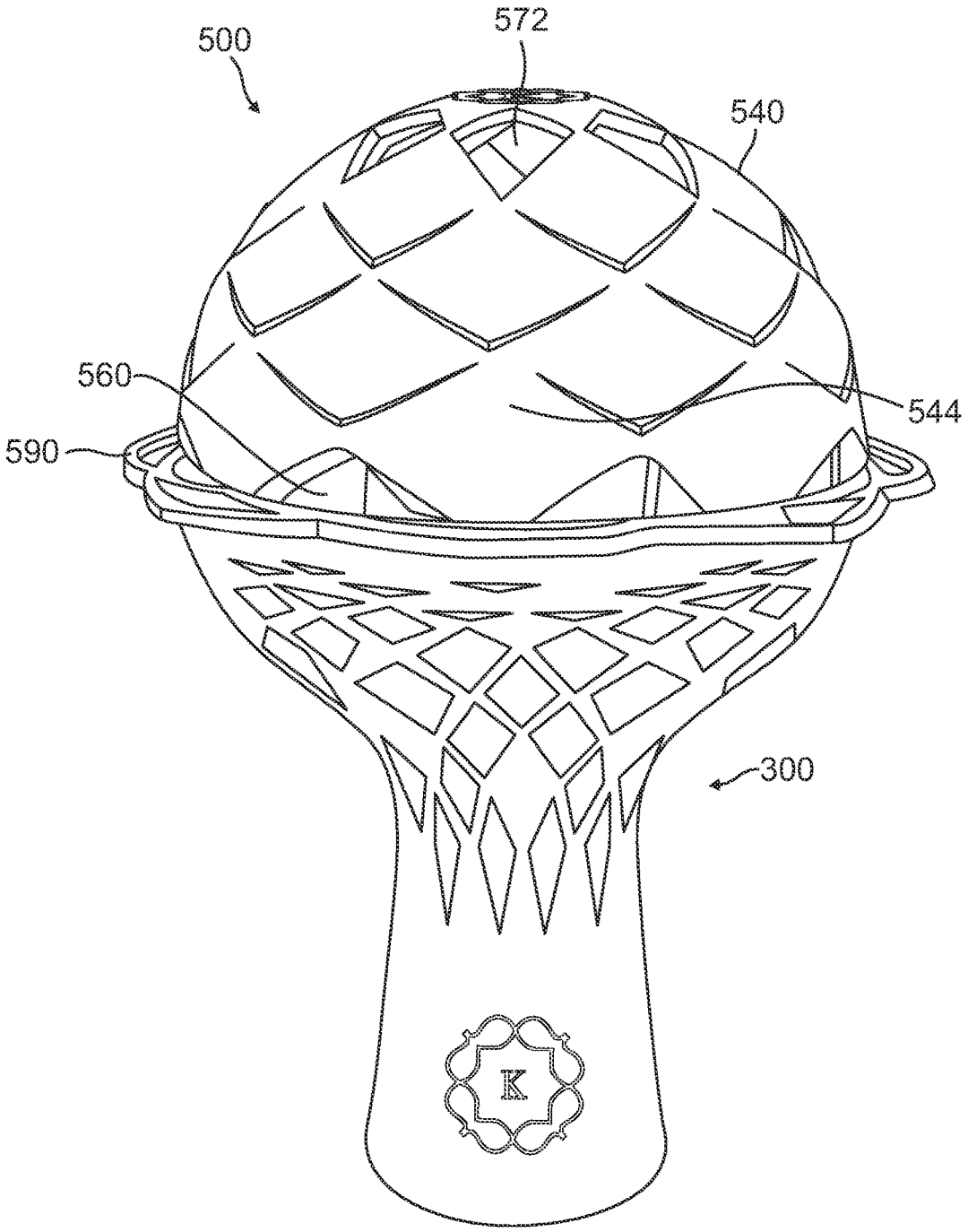
FIG. 5D shows a side view of the example embodiment of a coupled ventilated cover cap, platform and head in accordance with the invention.
Figure 5E:
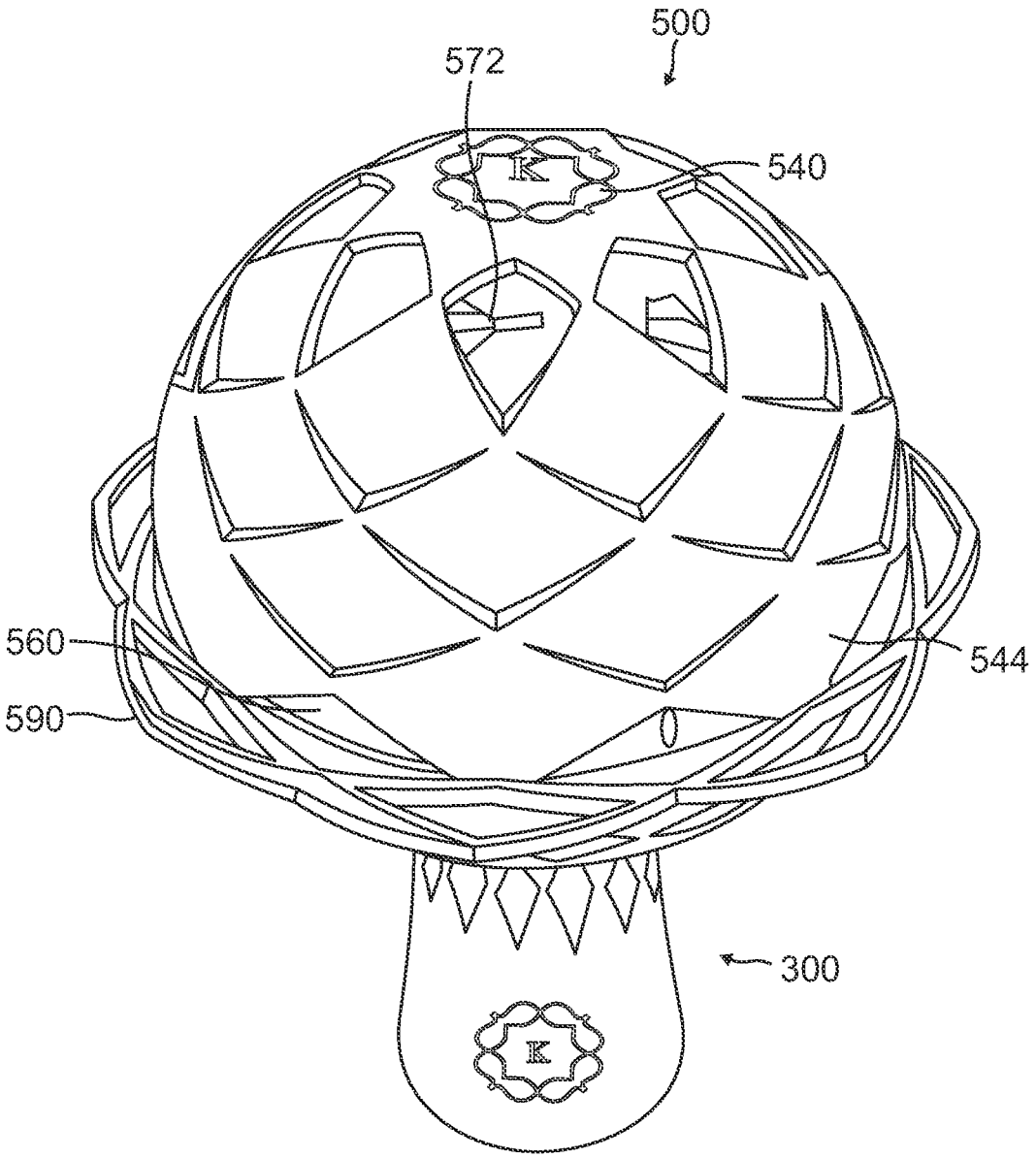
FIG. 5E shows a perspective view of the example embodiment of a coupled ventilated cover cap, platform and head in accordance with the invention.
Figure 5F:
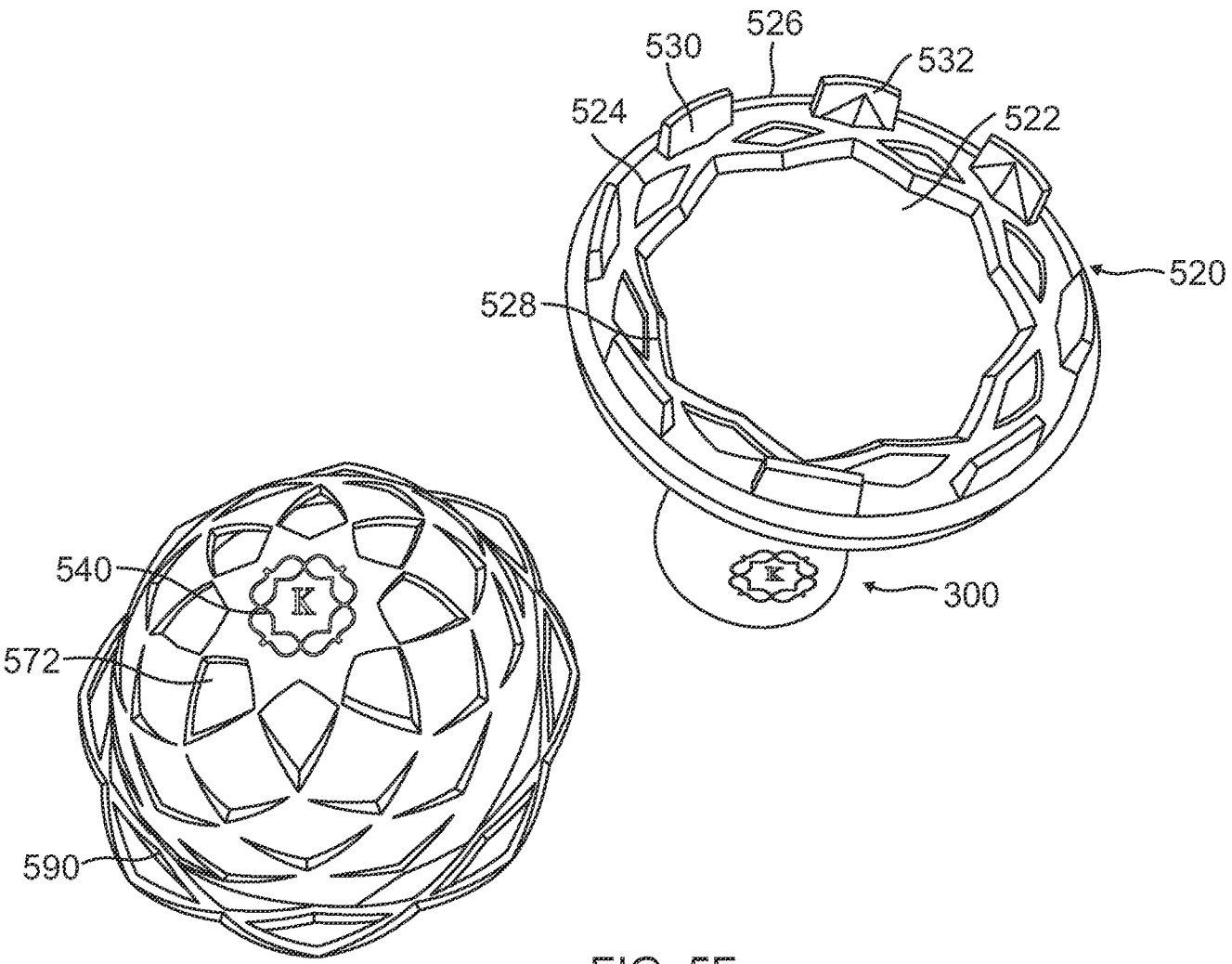
FIG. 5F shows a perspective view of the example embodiment of a coupled ventilated cover platform and head with decoupled ventilated cover cap in accordance with the invention.
Figure 5G:
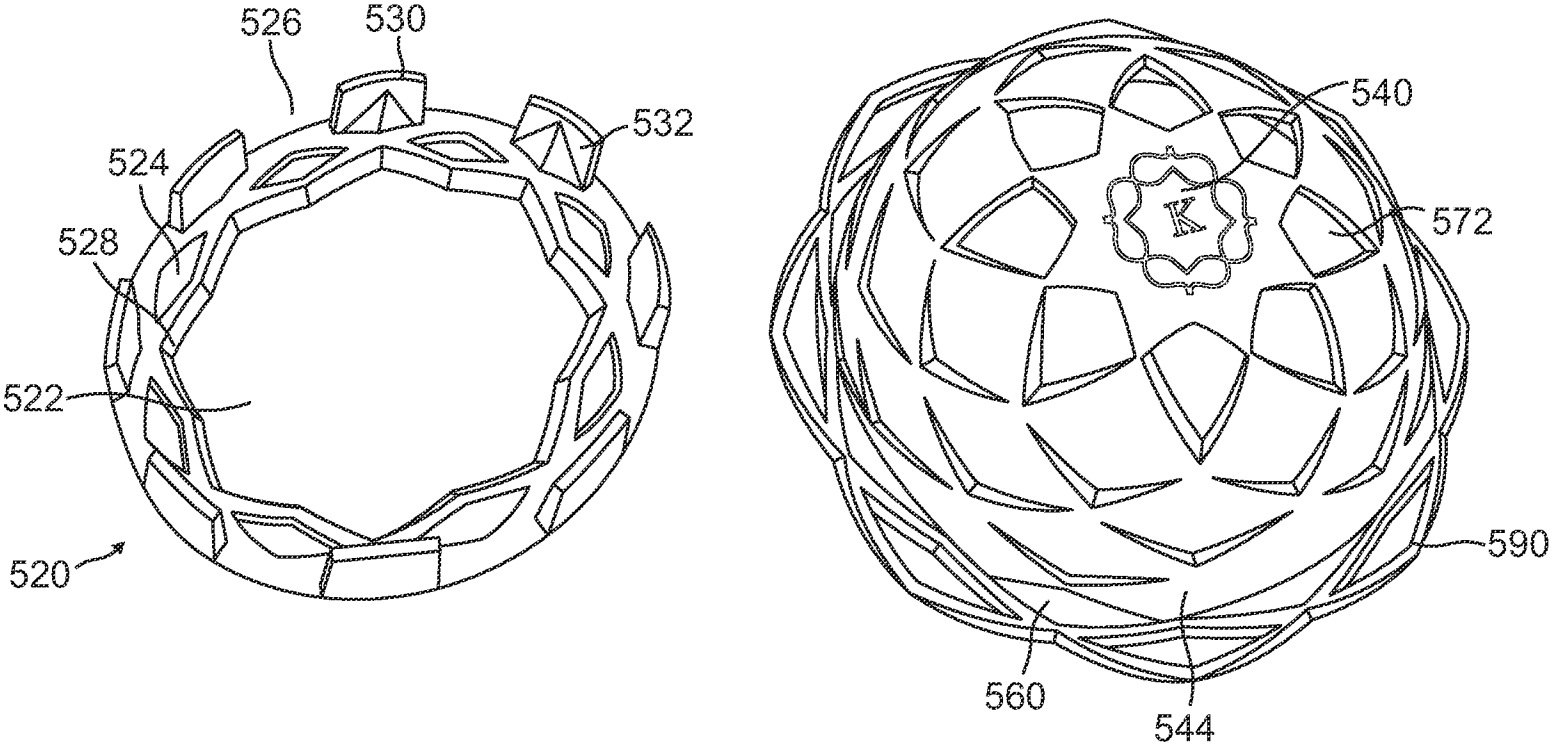
FIG. 5G shows a side view of the example embodiment of a decoupled ventilated cover cap and platform according the invention.

FIG. 5C shows a side view of an example embodiment of ventilated cover 500 and head 300 in accordance with the invention. FIGS. 5D-5E show an assembly of a head 300, with coupled platform 522 and cap 540. FIG. 5F shows a side view of the exemplary coupled ventilated cover platform 522 and head 300 with decoupled ventilated cover cap 540 in accordance with at least one embodiment of the invention. FIG. 5G shows a perspective view of an example embodiment of a decoupled ventilated cover cap 540 and platform 522 in accordance with at the invention.

Figure 6A:
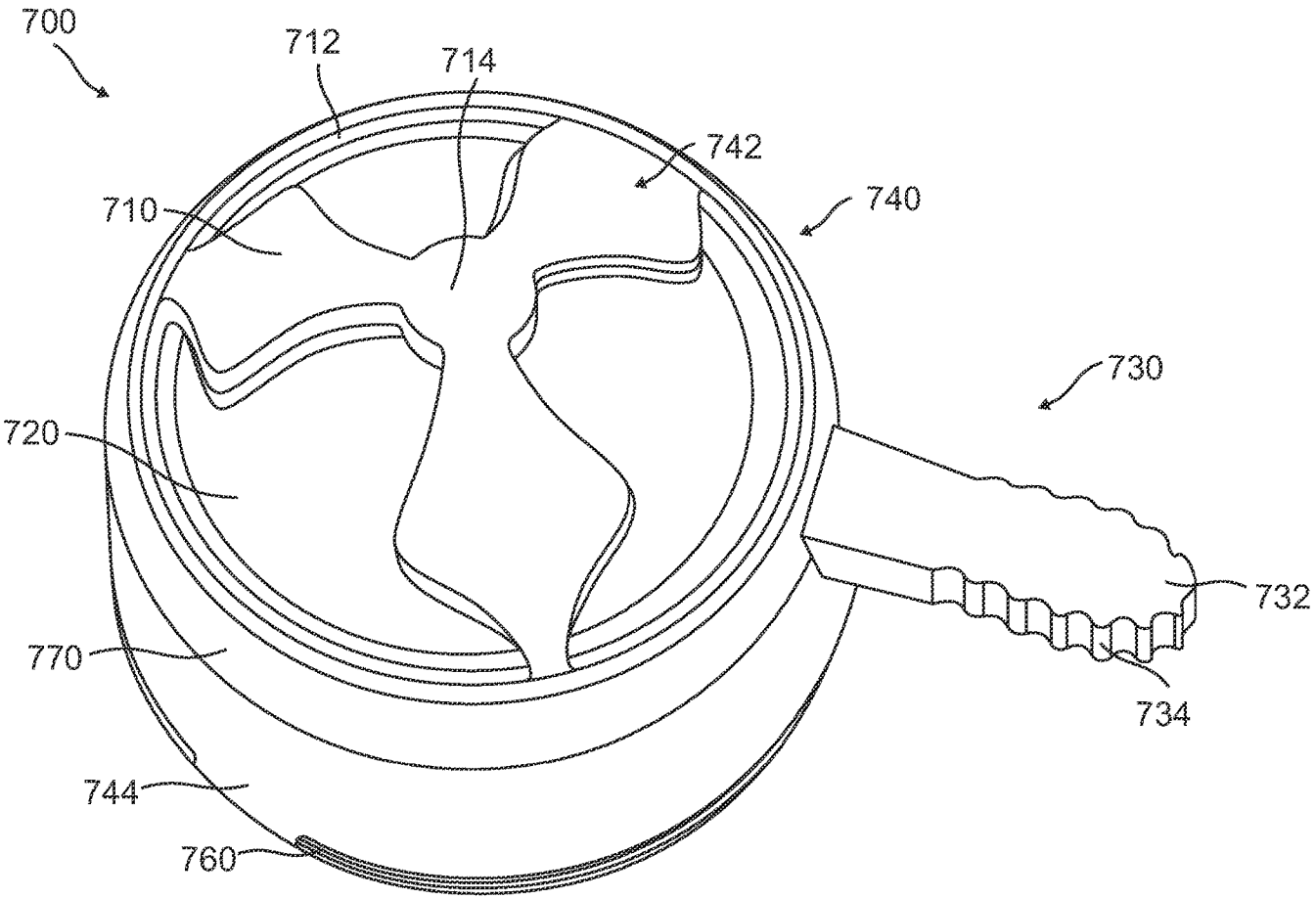
FIG. 6A shows a top perspective view of an example embodiment of a ventilated cover with closed cover vents in accordance with the present invention.

FIG. 6A shows a top view of a ventilated cover 700 with closed cover vents 750 in accordance with at least one alternative embodiment of the present invention. In the example embodiment a chamber wall 770 may include protrusions 744 that may mate with corresponding locations on platform 800 (shown in FIGS. 6D-6E), for instance with screws. These protrusions 744 may be separated from each other by gaps 760.

Cap 740 may have a handle 730 which may be coupled or integrated with cap 740. Handle 730 may include an insulated covering 732 which may have grip portions 734 such as ridges, bumps or other protrusions or features. Cap 740 may have an upper cap 742 as a wheel 712, hub 714 and spokes 710. In the example embodiment spokes 710 may have a substantially diamond shape. This may correspond with an upper vent 750 in a lower cap 720 such that in a closed configuration as shown in FIG. 6A, little airflow is permitted between an interior chamber and exterior. Upper cap 742 and lower cap 720 may be coupled at hub 714 such that they may rotate with respect to each other for adjustment of airflow. Coupling may be achieved by a screw and washer or other means. Lower cap may be maintained in position by one or more posts which extend into a heating chamber 780 and contact an inner wall of chamber wall 770. Posts may also contact upper ends of protrusions 744 in some embodiments to prevent rotation of lower cap 720 at the same rate as upper cap 742.

Figure 6B:
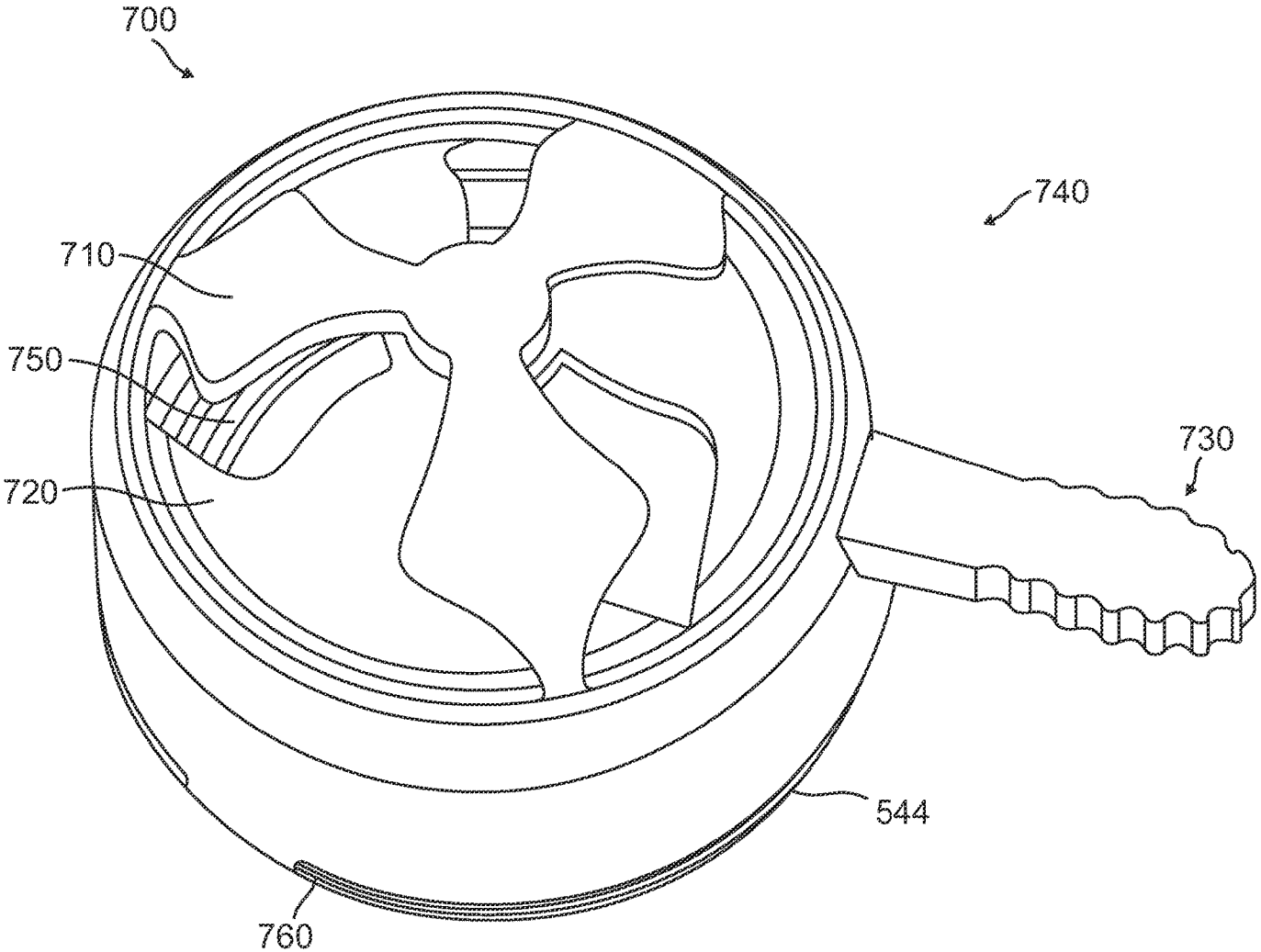
FIG. 6B shows a top perspective view of an example embodiment of a ventilated cover with partially closed cover vents in accordance with the present invention.
Figure 6C:
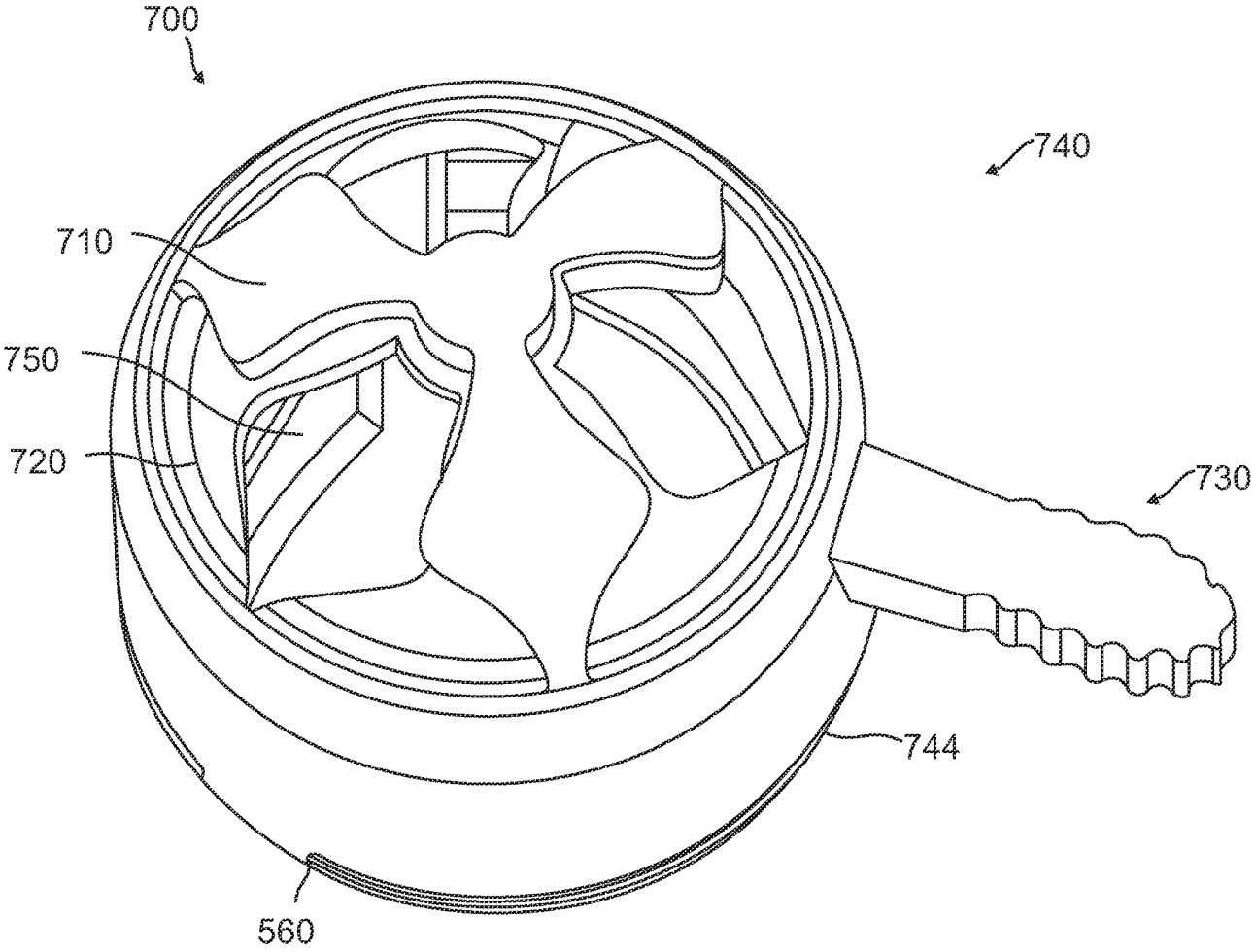
FIG. 6C shows a top perspective view of a ventilated cover with open cover vents in accordance with at least one embodiment of the present invention.

FIG. 6B shows a top view of a ventilated cover 700 with partially closed upper vents 750 in accordance with at least one embodiment of the present invention while FIG. 6C shows a top view of a ventilated cover 700 with open cover vents 750 in accordance with at least one embodiment of the present invention. Cover vents 750 may be adjusted by a user rotating upper cap 742 with respect to lower cap 720 using handle 730.

Figure 6D:
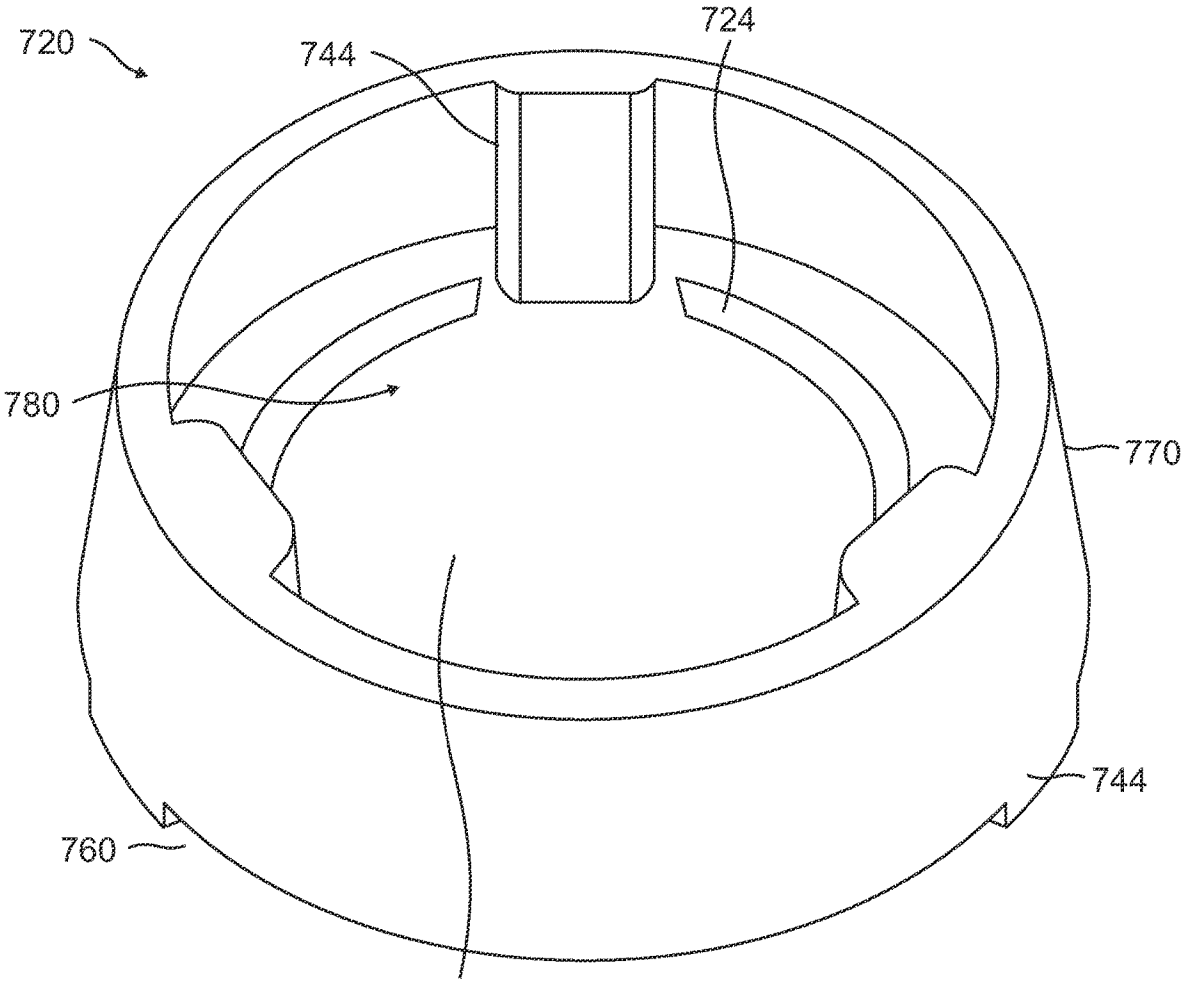
FIG. 6D shows a top perspective view of an example embodiment of a ventilated cover with top removed in accordance with the present invention.

FIG. 6D shows a top view of a ventilated cover with cap 740 removed in accordance with at least one embodiment of the present invention. In the example embodiment platform 722 may include a surface where a heating source may rest and perimeter bowl vents 724 may allow air exchange from a heating chamber to a bowl (not shown) below platform 722. Chamber wall 770 may have an upper surface 772 on which a lower surface of one or both of upper cap 742 and lower cap 720 rest. In some embodiments ridges or other regular or irregular features may allow airflow below a heating source and improve airflow with the chamber.

Figure 6E:
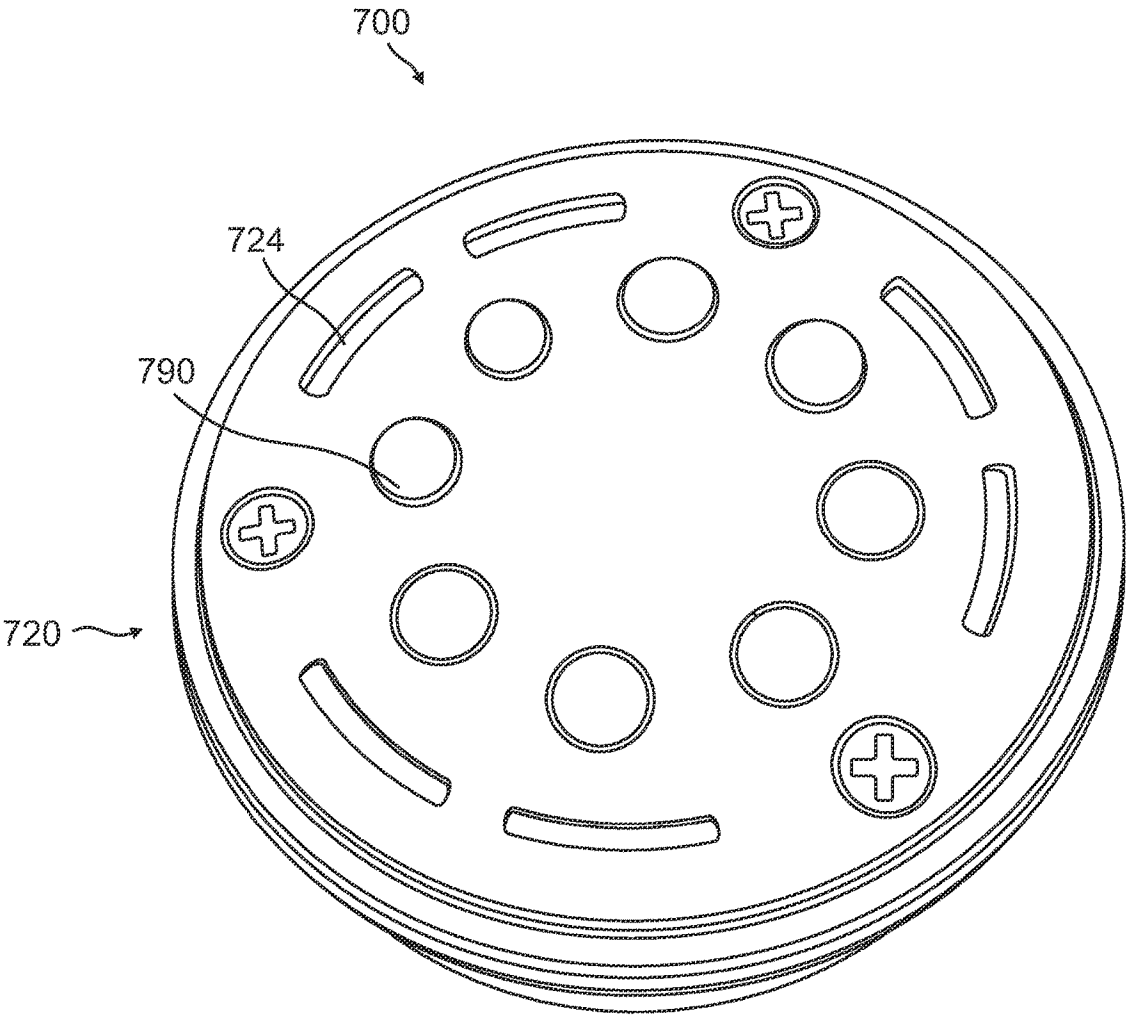
FIG. 6E shows an example embodiment of a bottom perspective view of a ventilated cover in accordance with the present invention.

FIG. 6E shows a bottom view of a ventilated cover 700 in accordance with at least one embodiment of the present invention. In the example embodiment platform 722 may have small nodules 790 which rest inside a bowl. In some embodiments these nodules 790 may direct heat into individual chambers of the bowl. Nodules 790 may also prevent ventilated cover 700 from inadvertently sliding or being knocked off of a head (not shown) since they may rest inside a bowl of a head.

Figure 7B:
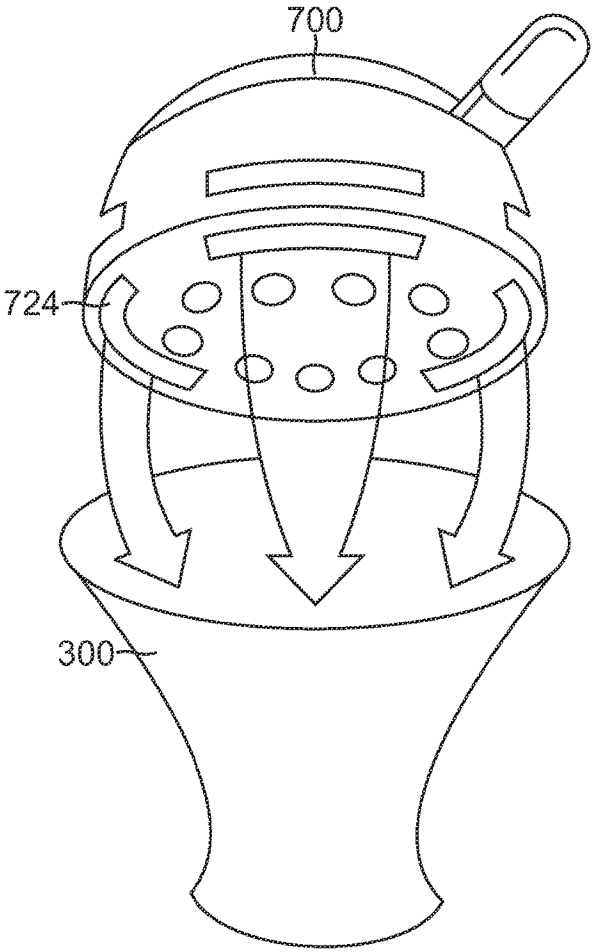
FIG. 7A-7E show an example embodiment of a use case of a ventilated cover in accordance with the present invention.
Figure 7A:
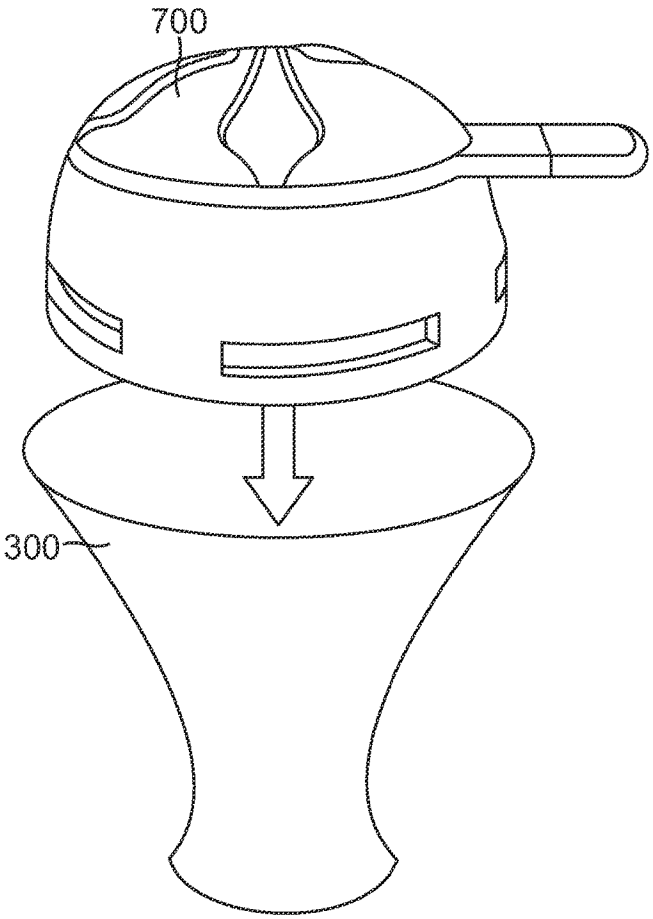
Figure 7D:
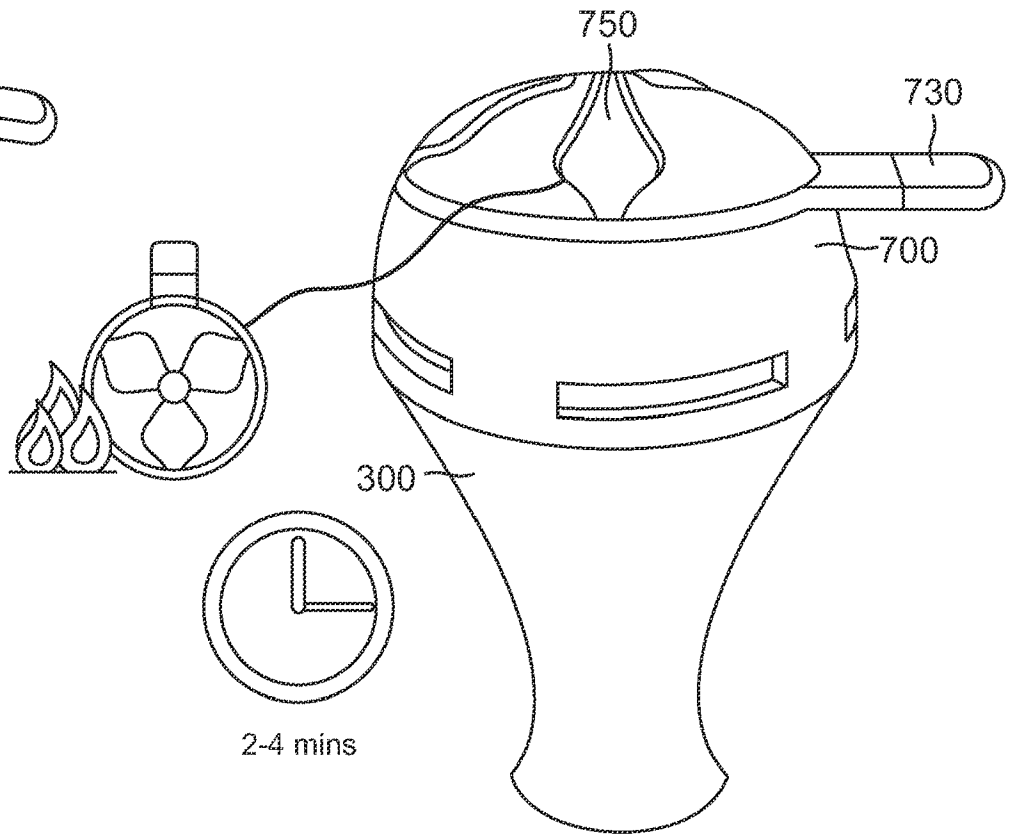
Figure 7C:
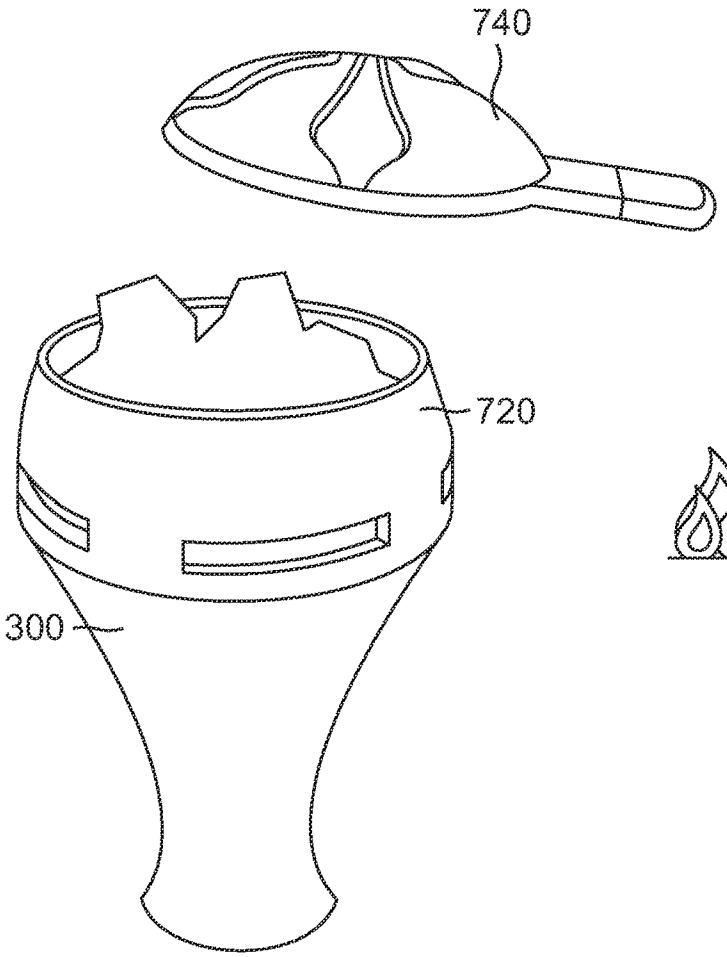
Figure 7E:
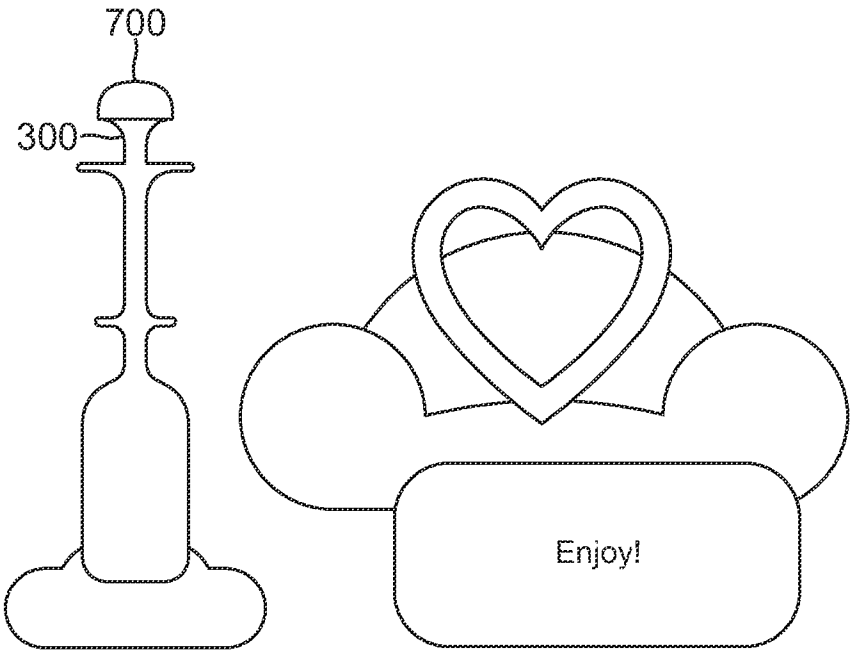

FIG. 7A-7E show a use case of a ventilated cover 700 in accordance with at least one embodiment of the present invention. In an example embodiment a ventilated cover 700 as disclosed herein may be placed on a water pipe head 300 as shown in FIG. 7A, such that at least one perimeter bowl vent (not shown) is oriented above the head 300, as shown in FIG. 7B. A heating source may be added within a heating chamber on a platform inside ventilated cover 700, as shown in FIG. 7C. This may be lit with a flame or otherwise heated such that the heating source produces heat. Vents may be closed to warm up the chamber and then the vents may be opened to an appropriate amount by rotating using arm or other adjustment mechanism in order to allow adequate ventilation. Users can wait two to four minutes or other appropriate lengths of time in order for tobacco or other organic matter to be appropriately heated, as shown in FIG. 7D. Air can be drawn through the heated tobacco or shisha contained in bowl 300 by a user inhaling through an adequately coupled hose and smoked and enjoyed accordingly, as shown in FIG. 7E.

In general, a ventilated cover 700 and bowl 300 may be washed by hand for optimal cleaning using hot water and soap or other appropriate cleaner. Likewise, a ventilated cover may be handled with tongs to ensure a user does contact surfaces which may be hot with the exception of handles or rims to adjust vents. When vents are open or a cap is removed, a ventilated cover 700 will generally be at its coolest temperature. When vents are closed, ventilated cover 700 may be at its hottest temperature. As such, bowl 300 will likewise be at a coolest and hottest temperature in accordance with these principles.

As would be understood by one in the art, features described herein and shown in the figures may be combined in appropriate combinations and are thus contemplated herein. Further, although FIG. 7 particularly illustrates a use case of the example embodiment ventilated cover 700 shown in FIG. 6, it is understood that one of skill in the art would understand how to use any combination of features as described with respect to the embodiments disclosed herein, including other ventilated covers and bowls. Further, as would be understood in the art, the shapes disclosed herein are not limiting. For instance, a round bowl could be replaced by a triangular or square bowl in various embodiments, as could diamond shapes be replaced by others.

Figure 8A:
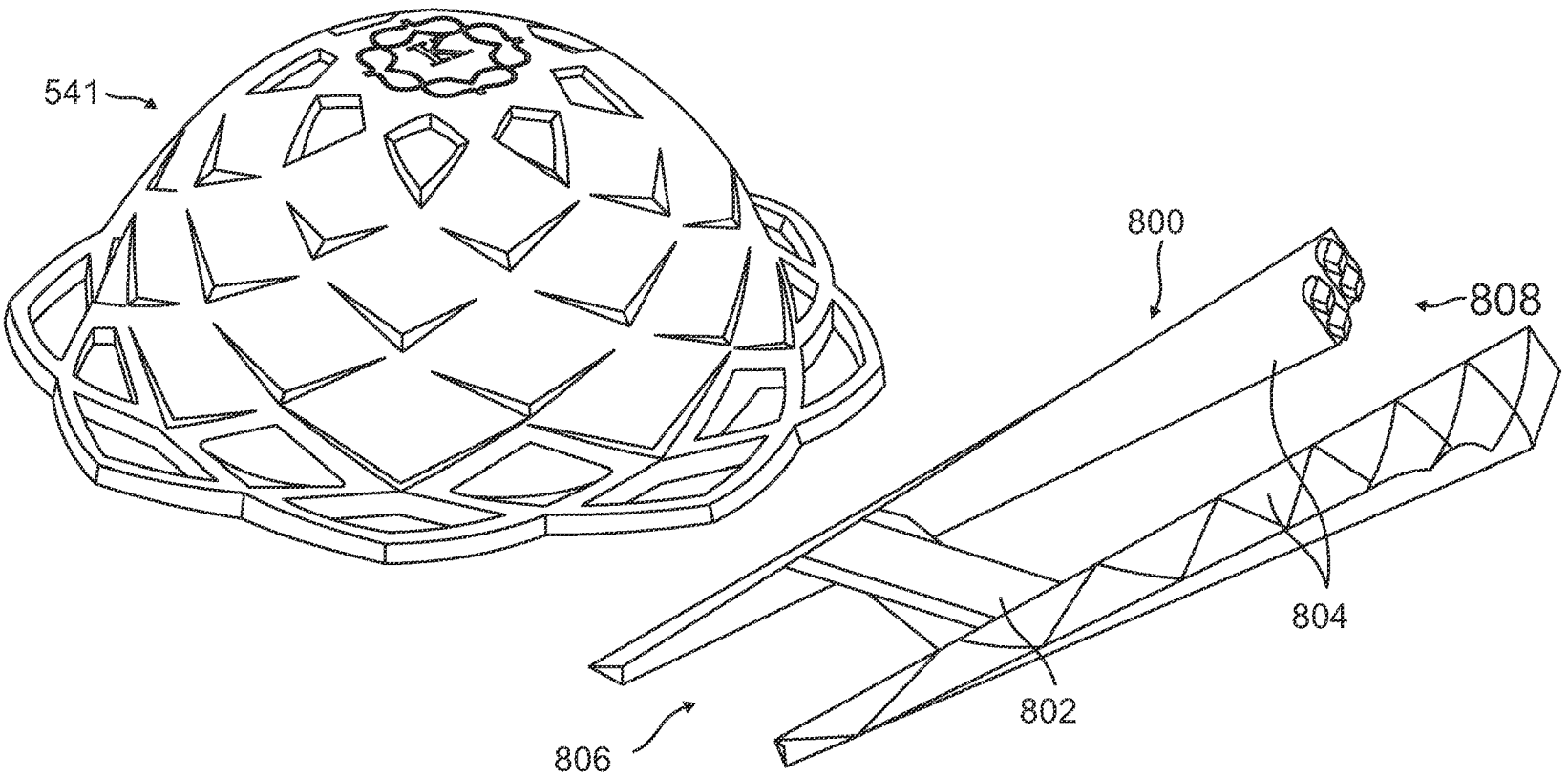
FIG. 8A shows an example embodiment of a perspective view of a ventilated cover cap and multi-functional tongs in accordance with the present invention.

FIG. 8A shows an example embodiment of a perspective view of a ventilated cover cap 541 and multi-functional tongs 800 in accordance with the present invention. In the example embodiment, tongs 800 can be used to adjust and remove various portions of a water pipe, including a ventilated cover cap 541.

Figure 8B:
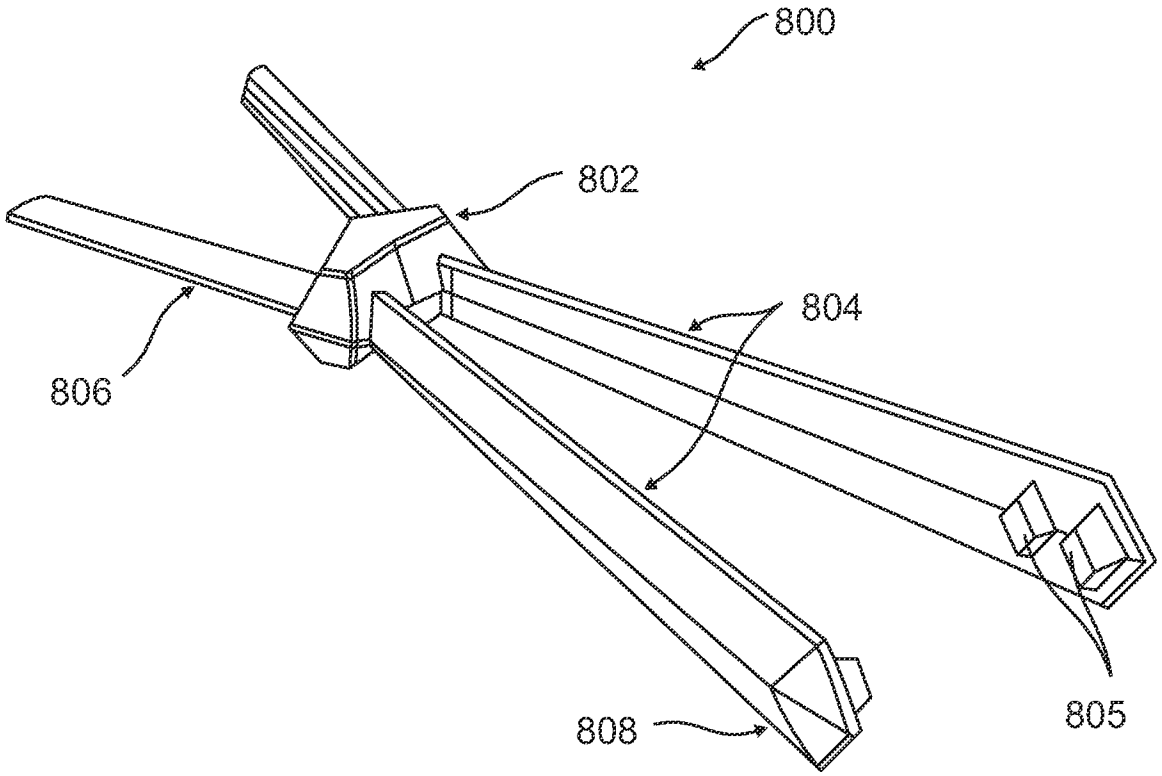
FIG. 8B shows an example embodiment of a perspective view of multi-functional tongs in accordance with the present invention.

FIG. 8B shows an example embodiment of a perspective view of multi-functional tongs 800 in accordance with the present invention. In the example embodiment, tongs 800 can include one, two, or more of legs 804 which can be made from a variety of materials, including stainless steel, silicone, wood, glass, or any combination thereof. Legs 804 can have a first end 806 which can interface with a lid. Legs 804 can have a second end 808 which can interface with charcoal or other heat source. As shown, second end 808 of tongs 800 can include one or more tong protrusions 805 to interface with charcoal or other heat sources. In some embodiments, tong protrusions 805 can provide insulation properties such that heat is not transferred directly to legs 804.

Legs 804 can be coupled at a hinge 802 which can be silicone, or some other flexible material, in various embodiments. Hinge 802 can provide users the ability to manipulate the first and second ends 806 and 808 in a simple and intuitive manner, without the possibility of dropping one leg 804. In this manner, legs 804 can be manipulated in a manner similar to chopsticks, but with additional functionality. In the example embodiment, legs 804 are shown as slightly bowed such that there is a gap between them at both first and second ends 806, 808.

Figure 8C:
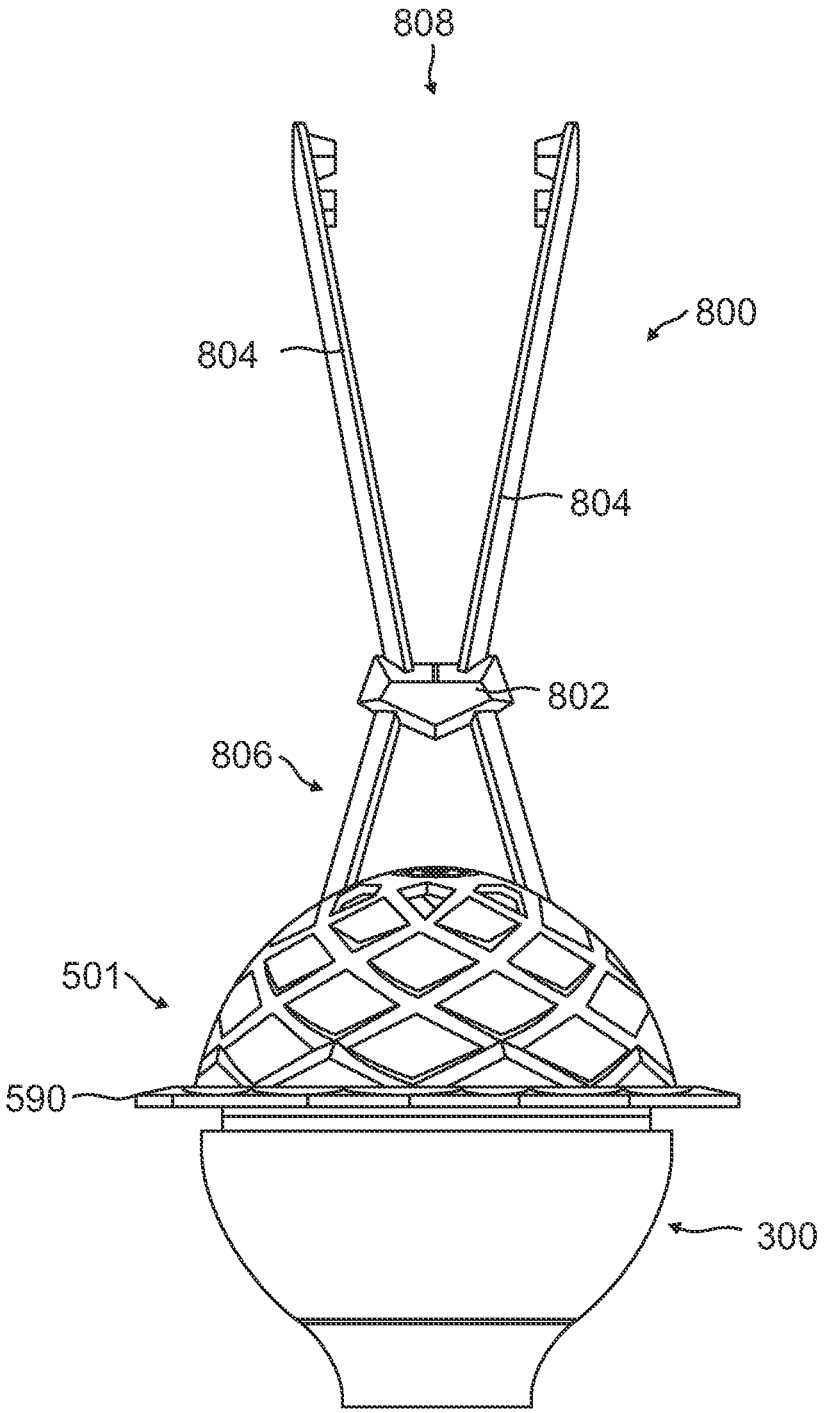
FIG. 8C shows an example embodiment of a side view of a ventilated cover and coupled bowl with multi-functional tongs in a use case in accordance with the present invention.

FIG. 8C shows an example embodiment of a side view of a ventilated cover 501 and coupled bowl 300 with multi-functional tongs 800 in a use case in accordance with the present invention. In the example embodiment tongs 800 are shown as coupled with ventilated cover 501 for manipulation with respect to bowl 300. Tongs 800 can also be coupled with elements 524, 560, 572, and 590. Thus, tongs 800 can be used to rotate, lift, and otherwise adjust ventilated cover 501. In the example embodiment, first end 806 of legs 804 can be shaped similarly in a complementary fashion to an interface surface of upper holes (e.g. 572 of FIG. 9A) of a ventilated cover 501. In this manner tongs 800 can be used to easily adjust ventilated cover 501. Although not shown, additional components and features of first end 806 can be provided in various embodiments of tongs 800 such as varied surfaces, materials, protrusions, projections and others in order to improve grip and promote convenient and intuitive usage for users. First end 806 of tongs 800 are not limited for use with upper holes of a ventilated cover 501 as shown. They can also be used to grasp, grip or otherwise adjust ventilated cover 501 at various other locations, for instance at rim 590 and at openings 524 and 560.

Figure 9A:
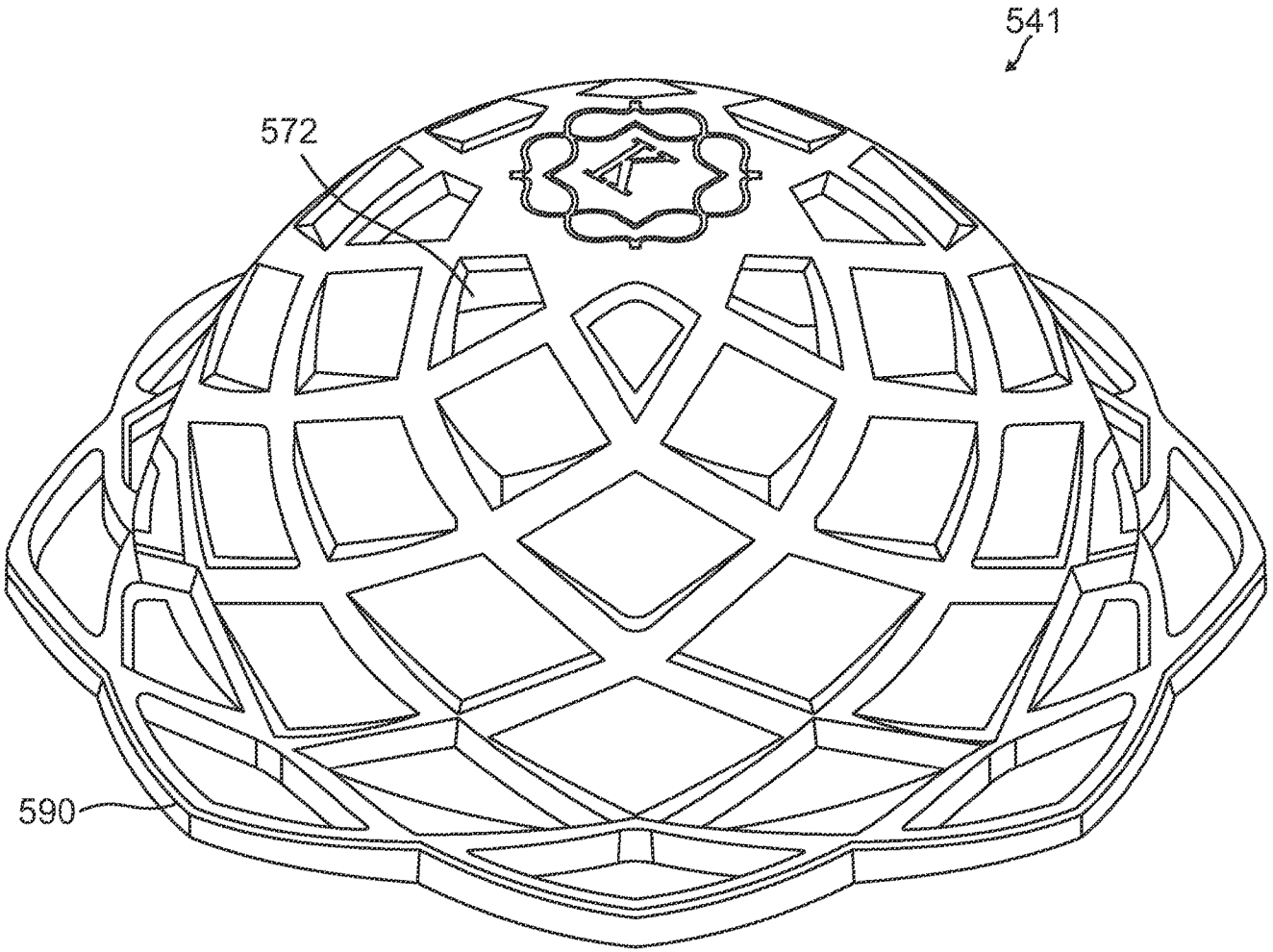
FIG. 9A shows an example embodiment of a top perspective view of a ventilated cover cap in accordance with the present invention.

FIG. 9A shows an example embodiment of a top perspective view of a ventilated cover cap 541 in accordance with the present invention. In the example embodiment, the upper surface and features of cap 541 can be similar to that shown in FIGS. 4A-4D.

Figure 9B:
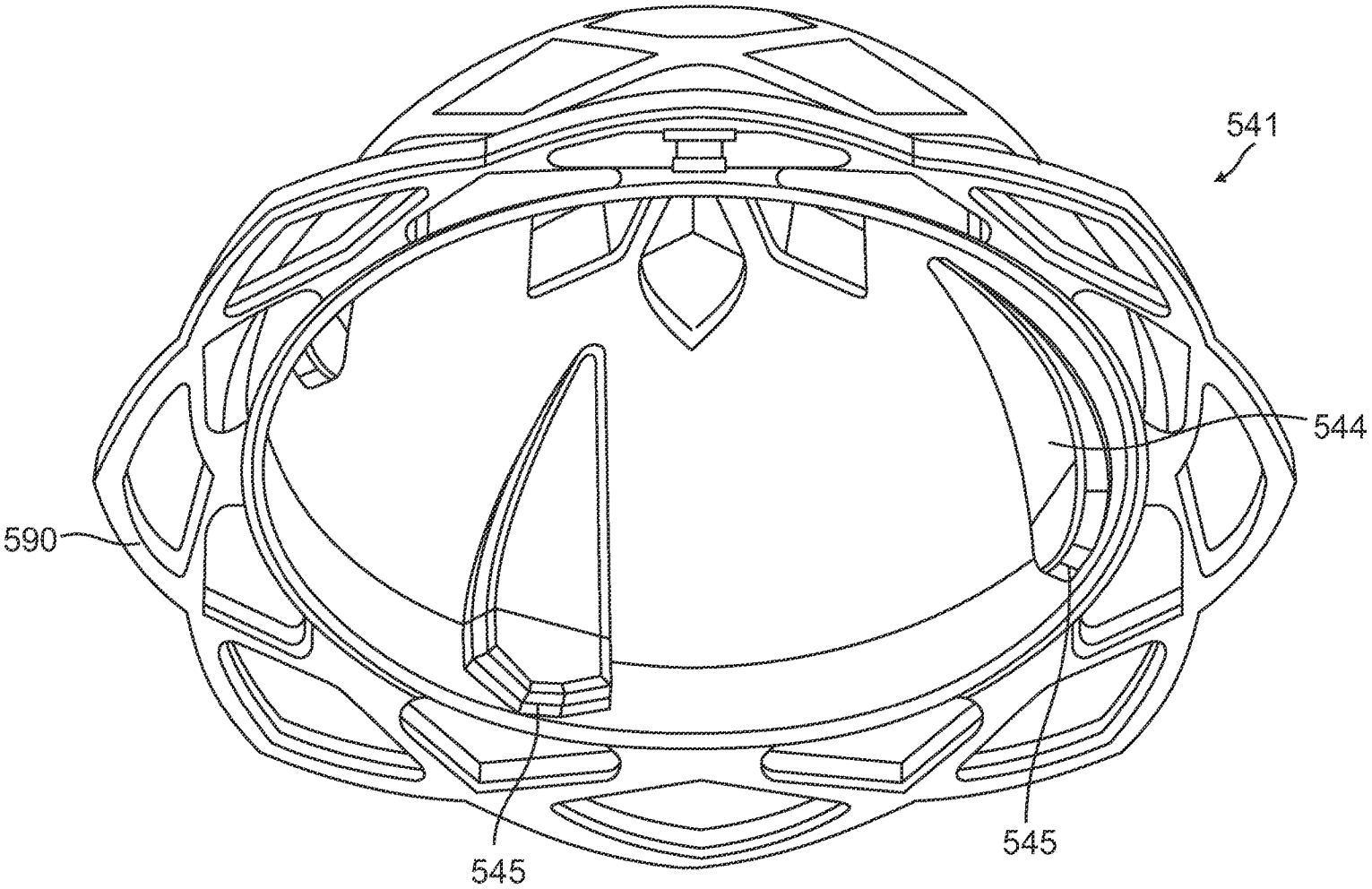
FIG. 9B shows an example embodiment of a bottom perspective view of a ventilated cover cap in accordance with the present invention.

FIG. 9B shows an example embodiment of a bottom perspective view of a ventilated cover cap 541 in accordance with the present invention. In the example embodiment, teeth 545 can be provided at a lower surface of protrusions 544. Teeth 545 can be locked or otherwise interface with a platform (e.g. 521 of FIG. 10) as shown in FIGS. 11A-11B. This can provide various benefits, including a secure interface with other components such that if a water pipe with ventilated cover cap 541 is knocked over, charcoal or other heat sources will be substantially contained and not fall on a floor, table or other supporting surface. This can help mitigate danger of burns, injury, scars and other damage associated with using heat sources. While four teeth 545 are provided in the example embodiment, other embodiments may include additional or fewer teeth 545.

Figure 10:
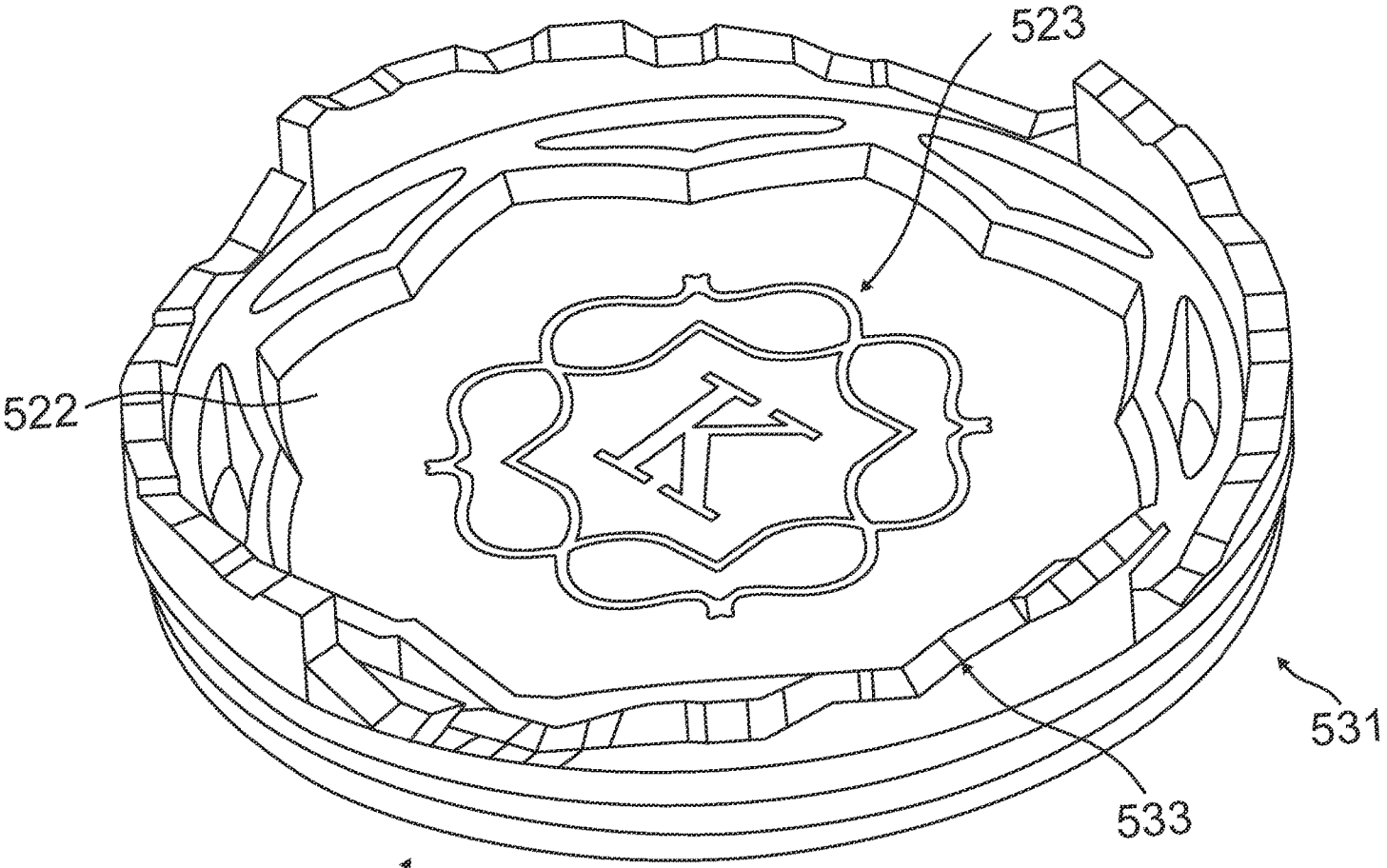
FIG. 10 shows an example embodiment of a top perspective view of a ventilated cover platform in accordance with the present invention.
Figure 11A:
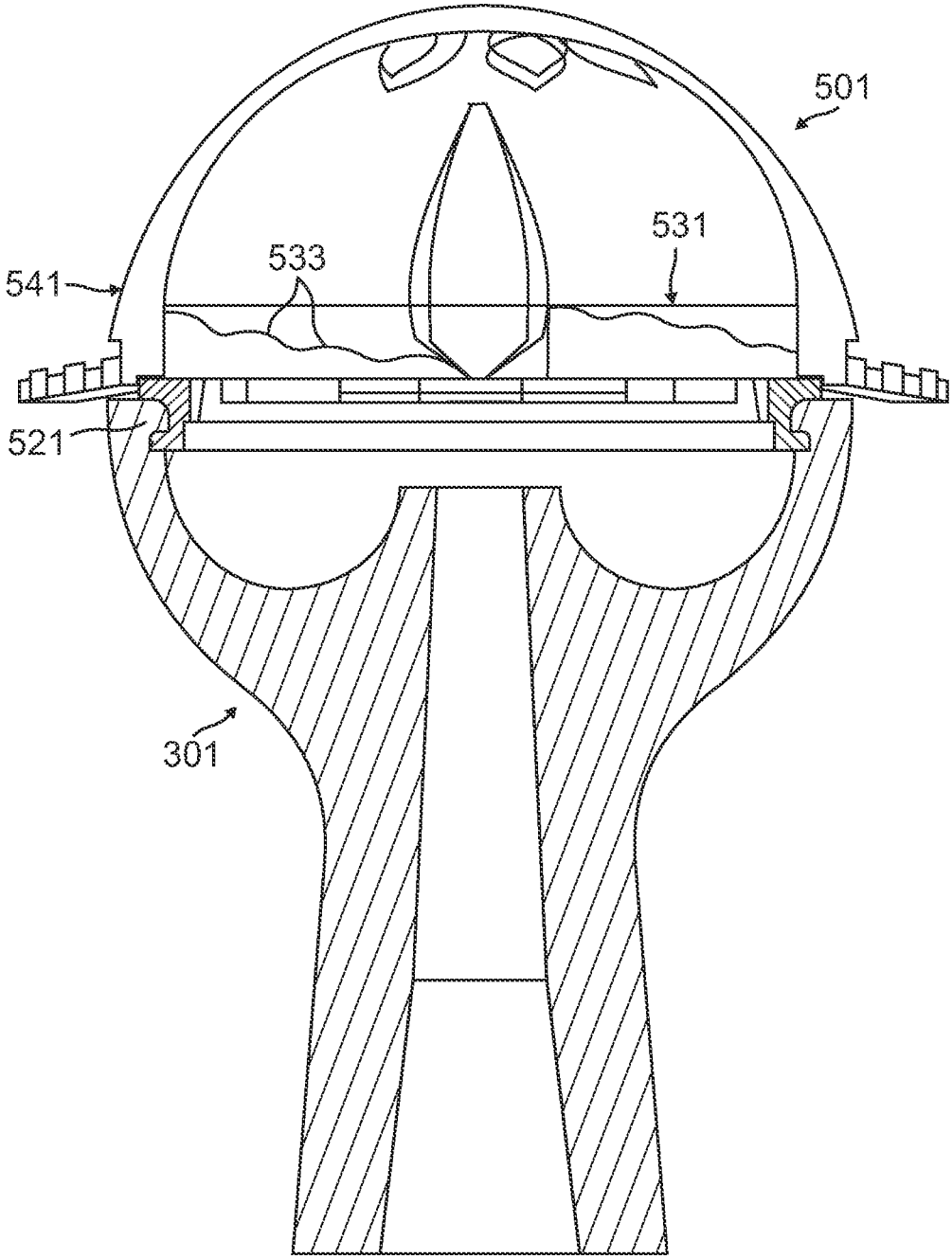
FIG. 11A shows a side cutaway view of an example embodiment of a coupled ventilated cover cap, platform and head in a closed configuration in accordance with the present invention.
Figure 11B:
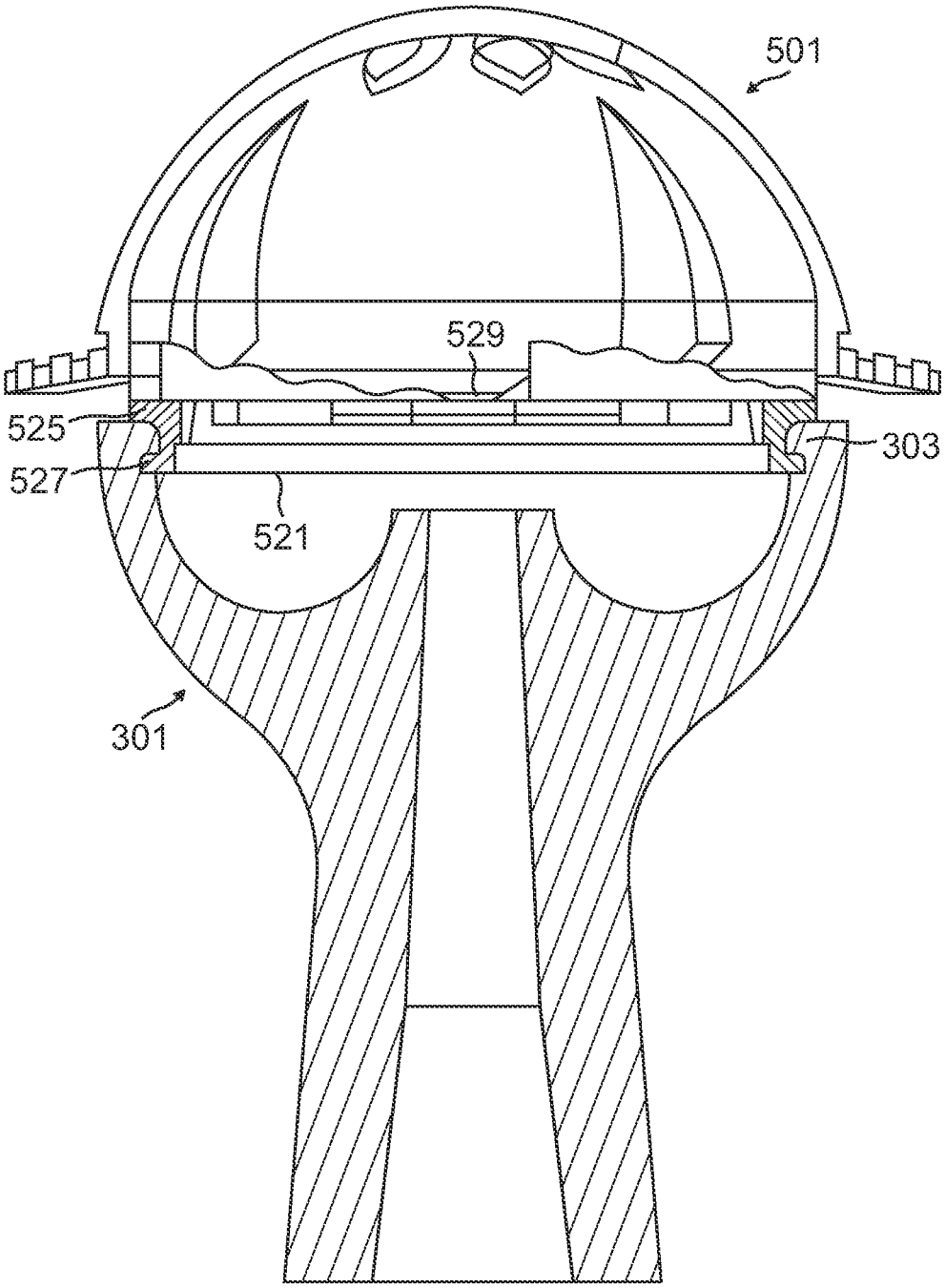
FIG. 11B shows a side cutaway view of an example embodiment of a coupled ventilated cover cap, platform and head in an open configuration in accordance with the present invention.

FIG. 10 shows an example embodiment of a top perspective view of a ventilated cover platform 521 in accordance with the present invention. In the example embodiment, a raised surface 523 can provide a slight elevation over a normal tray (not shown) or recessed tray 522 for charcoal or other heating elements. As such, heat emanating from the bottom of a heat source can be more evenly distributed across upper tray surfaces. Additionally, a ramp 531 with detents 533 can be provided in order to allow for more precise control of circumferential vents (see element 529 of FIG. 11B, similar to 526 of FIG. 5A). Ramp 531 with detents 533 can provide circumferential vent sizing in both a vertical and horizontal direction and thus the width and height of circumferential vents can be precisely controlled by placement at or on particular detents in order to increase or decrease airflow inside a ventilated cover cap 541. In some embodiments, teeth 545 provide the interface with ramp 531 and in some embodiments can be shaped to rest in detents 533.

FIG. 11A shows a side cutaway view of an example embodiment of a rotating lid 501 including coupled ventilated cover cap 541, platform 521 and head 301 in a closed configuration in accordance with the present invention. In the example embodiment, the rotating lid 501 is in a closed configuration, meaning that circumferential vents are sealed.

FIG. 11B shows a side cutaway view of an example embodiment of a rotating lid 501 including coupled ventilated cover cap 541, platform 521 and head 301 in an open configuration in accordance with the present invention. In the example embodiment, a user has rotated cap 541 with respect to platform 521, thus causing circumferential vents 529 to open and allow airflow into cap 541. Also shown are an interlock between a ridge 303 of base 301 and lower lip 529 and upper lip 525 of platform 521 to provide a seal, which in some embodiments is airtight, between rotating lid 501 and bowl 301. As such, lid 501 will not fall off of bowl 301 if adjusted or accidentally knocked over by a user or third party.

Figure 11C:
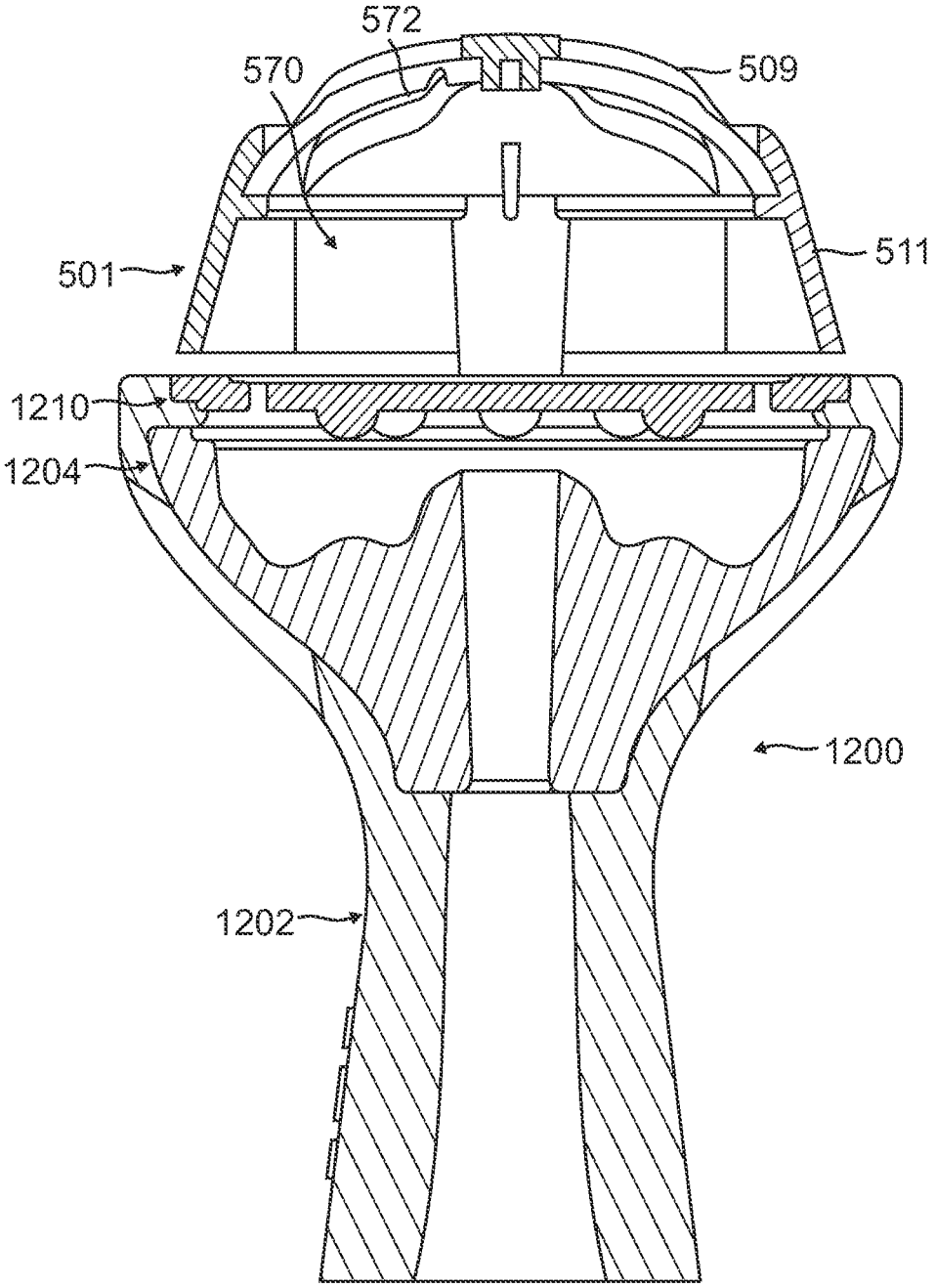
FIG. 11C shows an example embodiment of a ventilated cap coupled to a bowl.

FIG. 11C shows another example embodiment of a ventilated cap 501 coupled to a bowl 1200. In the example embodiment, ventilated cap 501 includes a chamber 511 with an adjustable upper component 509 allowing for separate adjustment of upper vents 572 with respect to heating chamber 570.

The embodiments described in detail above are considered novel over the prior art of record and are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element may be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what may be obviously substituted, and also what incorporates the essential ideas.

The scope of this description is to be interpreted only in conjunction with the appended claims and it is made clear, here, that the named inventor believes that the claimed subject matter is what is intended to be patented.

What is claimed is:

1. A system for facilitating smoking of tobacco from a hookah, comprising:

a heating platform for resting on a bowl and operable to contain tobacco or other smokable organic substance, further comprising:

a central surface including a recessed tray that is a depression defined by at least one inner wall surrounding the recessed tray, such that the inner wall prevents a heating source from sliding out of the recessed tray;

at least one perimeter vent allowing air to pass between an area above the central surface and an area below the central surface;

at least one exterior wall located around an exterior of the heating platform around an area above the central surface and that is distinct from and encompasses at least a portion of the inner surrounding wall; and at least one exterior wall vent located in the at least one exterior wall; and a ventilated cap for covering at least a portion of the heating platform comprising:

a solid cover;

at least one exterior cap vent;

at least one upper vent;

at least one movement control extension coupled to the solid cover; and at least one resting surface of the solid cover for resting on the heating platform, wherein the at least one perimeter vent is located exterior to the inner wall and adjacent the exterior wall, such that airflow through the at least one exterior wall vent and the at least one perimeter vent is unimpeded by the heating source.

2. The system of claim 1, wherein the heating platform further comprises:

ridges for coupling with the bowl of a water pipe.

3. The system of claim 1, wherein the heating platform further comprises:

nodules on a bottom surface of the heating platform.

4. The system of claim 1, wherein the at least one exterior cap vent is located adjacent a bottom of the solid cover, and wherein, in at least one orientation, the exterior cap vent is aligned with the at least one exterior wall vent of the heating platform when the ventilated cap is coupled to the heating platform.

5. The system of claim 4, wherein the position of the at least one exterior cap vent is adjustable using the movement control extension, such that adjusting the position of the at least one exterior cap vent with respect to the exterior wall vent of the heating platform modifies airflow characteristics through the exterior wall vent.

6. The system of claim 1, wherein the at least one movement control extension is an arm.

7. The system of claim 1, wherein the at least one movement control extension is a rim that extends outward around a perimeter of the ventilated cap.

8. The system of claim 1, wherein the ventilated cap further comprises:

an interior ventilated cap; and an exterior ventilated cap.

9. The system of claim 8, wherein movement of the at least one movement control extension by a user adjusts the position of the exterior ventilated cap with respect to the interior ventilated cap.

10. The system of claim 9, wherein the at least one upper vent further comprises:

an interior ventilated cap upper vent; and an exterior ventilated cap upper vent, wherein adjusting the exterior ventilated cap with respect to the interior ventilated cap modifies an orientation of the exterior ventilated cap upper vent with respect to the interior ventilated cap upper vent.

11. The system of claim 9, wherein the exterior ventilated cap and interior ventilated cap are coupled such that they operably rotate with respect to each other when one or both are adjusted by a user.

12. The system of claim 1, wherein the movement control extension operably lifts the ventilated cap off the heating platform when picked up by a user.

13. The system of claim 1, wherein the heating platform has a central axis perpendicular to the central surface and a lower edge of the ventilated cap is located at a further radial distance from the central axis of the heating platform surface than a radial distance of an outer circumference of the heating platform.

14. The system of claim 1, wherein the ventilated cap is operable to be fixedly coupled with the heating platform.

15. The system of claim 1, wherein the heating platform is operable to be fixedly coupled with the bowl when resting on the bowl.

16. The system of claim 1, wherein the heating platform further comprises:

at least one ramp for supporting the ventilated cap, and the ramp comprises at least one detent.

* * * * *